US011054771B2

(12) United States Patent
Kunimori

(10) Patent No.: US 11,054,771 B2
(45) Date of Patent: Jul. 6, 2021

(54) IMAGE FORMATION APPARATUS AND HEATER CONTROL METHOD

(71) Applicant: Oki Data Corporation, Tokyo (JP)

(72) Inventor: Osamu Kunimori, Tokyo (JP)

(73) Assignee: Oki Electric Industry Co., Ltd., Tokyo (JP)

( * ) Notice: Subject to any disclaimer, the term of this patent is extended or adjusted under 35 U.S.C. 154(b) by 0 days.

(21) Appl. No.: 16/846,374

(22) Filed: Apr. 12, 2020

(65) Prior Publication Data

US 2020/0341411 A1 Oct. 29, 2020

(30) Foreign Application Priority Data

Apr. 23, 2019 (JP) ..... JP2019-081942

(51) Int. Cl.
*G03G 15/20* (2006.01)
*G03G 15/00* (2006.01)

(52) U.S. Cl.
CPC ..... *G03G 15/205* (2013.01); *G03G 15/2053* (2013.01); *G03G 15/5004* (2013.01)

(58) Field of Classification Search
CPC ..... G03G 15/205
See application file for complete search history.

(56) References Cited

U.S. PATENT DOCUMENTS 6,157,010 A * 12/2000 Mine ..... G03G 15/2003 219/216
8,761,630 B2 * 6/2014 Hikari ..... G03G 15/2042 399/88
2019/0302663 A1 * 10/2019 Harada ..... H05B 1/0241

FOREIGN PATENT DOCUMENTS

JP H9-230740 A 9/1997

* cited by examiner

*Primary Examiner* — Victor Verbitsky
(74) *Attorney, Agent, or Firm* — Metrolex IP Law Group, PLLC

(57) ABSTRACT

An image formation apparatus according to an embodiment may include: a fixation device including a first heater and a second heater whose electric power is smaller than the first heater; first and second switches to supply a power supply signal to the first and second heaters; and a heater controller. The heater controller: turns on the second switch at a first timing; turns off the second switch at a second timing at which a first length of time equal not less than a predetermined time length is elapsed from the first timing; turns on the first switch at a third timing after the second timing; and turns on the second switch at a fourth timing at which a second length of time not less than the predetermined time length is elapsed from the third timing.

12 Claims, 16 Drawing Sheets

IMAGE FORMATION APPARATUS AND HEATER CONTROL METHOD

CROSS REFERENCE TO RELATED APPLICATIONS

This application claims priority based on 35 USC 119 from prior Japanese Patent Application No. 2019-081942 filed on Apr. 23, 2019, entitled "IMAGE FORMATION APPARATUS AND HEATER CONTROL METHOD", the entire contents of which are incorporated herein by reference.

BACKGROUND

The disclosure may relate to an image formation apparatus to form an image on a recording medium and a heater control method for an image formation apparatus.

An image formation apparatus forms a toner image, transfers the toner image on a recording medium, and fixes the transferred toner image to the recording medium by a fixation device, for example. In a fixation operation, the image formation apparatus controls power supply to a heater provided in the fixation device. For example, Patent Literature 1 discloses a heater controller to controls power supply to a heater.

Patent Literature 1: Japanese Patent Application Publication No. 09-230740

SUMMARY

To such an image formation apparatus, an electric power is supplied from a power source such as a commercial power source. When turning on and off a heater of the image formation apparatus, a voltage of the power source may fluctuate. This may not improve a user-friendliness of the image formation apparatus.

An object of an aspect of one or more embodiments is to provide an image formation apparatus and a heater control method capable of improving a user-friendliness of the image formation apparatus.

An aspect of one or more embodiments may an image formation apparatus that may include: an image formation unit that forms an image on a recording medium by using a developer; a fixation device including a first heater and a second heater, wherein the first heater generates heat with a first heater electric power and the second heater generates heat with a second heater electric power smaller than the first heater electric power; a first switch to supply a power supply signal to the first heater; a second switch to supply the power supply signal to the second heater; and a heater controller that controls supply of the power supply signal to the first switch and the second switch. Upon a first operation to transition from a state where the first and second switches are off to a state where the first and second switches are on, the heater controller: at a first timing, turns on the second switch from an off-state thereof; at a second timing at which a first length of time equal to or longer than a predetermined time length has elapsed from the first timing, turns off the second switch from an on-state thereof; at a third timing after the second timing, turns on the first switch from an off-state thereof; and at a fourth timing at which a second length of time equal to or longer than the predetermined time length has elapsed from the third timing, turns on the second switch from the off-state thereof.

An aspect of one or more embodiments may be a method of controlling a heater that may include: a first operation to transition from a state where first and second switches are off to a state where the first and second switches are on, wherein the first switch is configured to supply a power supply signal to a first heater that generates heat with a first heater electric power and the second switch is configured to supply the power supply signal to a second heater that generates heat with a second heater electric power smaller than the first heater electric power. The first operation may include: at a first timing, turning on the second switch from an off-state thereof; at a second timing at which a first length of time equal to or longer than a predetermined time length has elapsed from the first timing, turning off the second switch from an on-state thereof; at a third timing after the second timing, turning on the first switch from an off-state thereof; and at a fourth timing at which a second length of time equal to or longer than the predetermined time length has elapsed from the third timing, turning on the second switch from the off-state thereof.

Therefore, the image formation apparatus and the method of controlling the heater according to the above aspects can improve a user-friendliness of the image formation apparatus.

DETAILED DESCRIPTION

Figure 1:
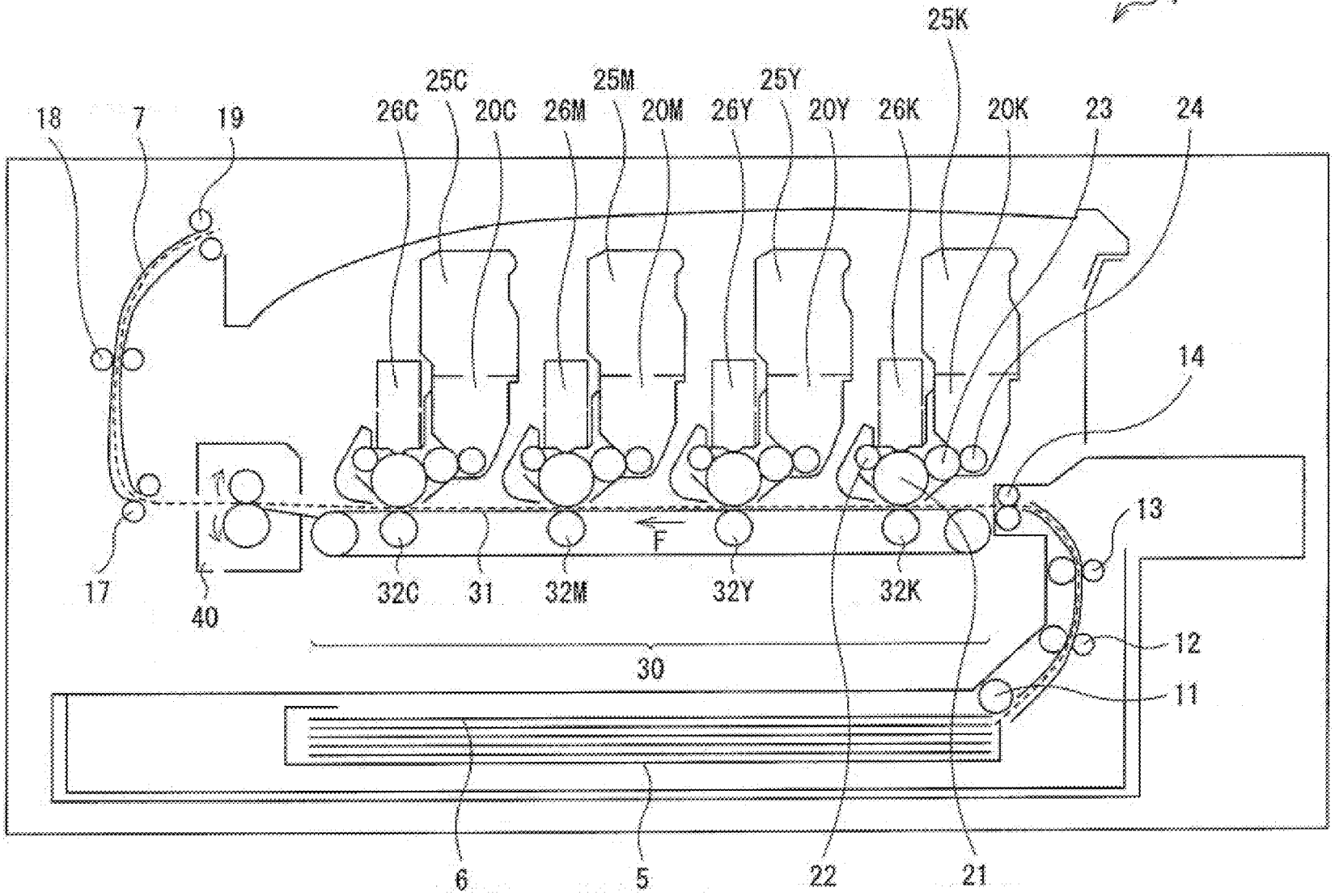
FIG. 1 is a diagram illustrating a view of an example of a configuration of an image formation apparatus according to an embodiment.

Descriptions are provided hereinbelow for one or more embodiments based on the drawings. In the respective drawings referenced herein, the same constituents are designated by the same reference numerals and duplicate explanation concerning the same constituents is omitted. All of the drawings are provided to illustrate the respective examples only.

EMBODIMENTS

Configuration Example

FIG. 1 is a diagram illustrating a view of a configuration example of an image formation apparatus (image formation apparatus 1) according to an embodiment. For example, the image formation apparatus 1 may be an electrophotographic printer that forms an image on a recording medium such as a plain paper or the like. Note that a heater control method according to an embodiment is also described below along with descriptions of the image formation apparatus.

The image formation apparatus 1 includes a medium container 5 or a medium tray, a pick-up roller 11, conveyance rollers 12 and 13, a resist roller 14, four image formation units 20 (image formation units 20K, 20Y, 20M, and 20C), four toner containers 25 (toner containers 25K, 25Y, 25M, and 25C), four exposure units 26 (exposure units 26K, 26Y, 26M, and 26C), a transfer unit 30, a fixation device 40, conveyance rollers 17 and 18, and a discharge roller 19. These components are arranged along a conveyance path 7 in which a recording medium 6 is conveyed.

The medium container 5 is configured to accommodate therein the recording media 6. The pick-up roller 11 is a member that picks up an uppermost one of the recording media 6 in the medium container 5 one by one, and feeds the picked-up recording medium 6 to the conveyance path 7.

The conveyance rollers 12 include a pair of rollers that sandwiches the conveyance path 7 therebetween. The conveyance rollers 13 include a pair of rollers that sandwiches the conveyance path 7 therebetween. The conveyance rollers 12 and 13 convey the recording medium 6 fed from the pick-up roller 11 along the conveyance path 7.

The resist rollers 14 include a pair of rollers that sandwiches the conveyance path 7 therebetween, and configured to correct a skew of the recording medium 6 while conveying the recording medium 6 toward the four image formation units 20 along the conveyance path 7.

Each of the four image formation units 20 (image formation units 20K, 20Y, 20M, and 20C) is configured to form a toner image serving as a developer image. Specifically, the image formation unit 20K forms a black toner image, the image formation unit 20Y forms a yellow toner image, the image formation unit 20M forms a magenta toner image, and the image formation unit 20C forms a cyan toner image. The image formation units 20K, 20Y, 20M, and 20C are arranged in this order toward the conveyance direction F of the recording medium 6. Each of the four image formation units 20 includes a photosensitive member 21, a charging roller 22, the development roller 23, and the supply roller 24.

The photosensitive member 21, such as a photosensitive drum or the like, is configured to carry on the surface (the surface layer) thereof an electrostatic latent image. The photosensitive member 21 is driven by a driving force from a photosensitive drum motor (not illustrated), so as to be rotated in a clockwise direction in this example. The surface of the photosensitive member 21 is charged by the charging roller 22 and is exposed by the corresponding exposure unit 26. Specifically, the photosensitive member 21 of the image formation unit 20K is exposed by the exposure unit 26K, the photosensitive member 21 of the image formation unit 20Y is exposed by the exposure unit 26Y, the photosensitive member 21 of the image formation unit 20M is exposed by the exposure unit 26M, and the photosensitive member 21 of the image formation unit 20C is exposed by the exposure unit 26C. With this, on the surface of each photosensitive member 21, an electrostatic latent image is formed. Then, a toner, serving as a developer, is supplied from the development roller 23 to the surface of the photosensitive member 21 to develop the electrostatic latent image, so as to form a toner image on the surface of the photosensitive member 21.

The charging roller 22 is configured to charge the surface (surface layer) of the photosensitive member 21. The charging roller 22 is provided to be in contact with the surface (circumferential surface) of the photosensitive member 21 with a predetermined press amount against the photosensitive member 21. The charging roller 22 is rotated in the counterclockwise direction in this example, corresponding to the rotation of the photosensitive member 21. To the charging roller 22, a predetermined charging voltage is applied from a later-described high voltage power supply part 63.

The development roller 23 is configured to carry, on the surface thereof, the charged toner. The development roller 23 is provided to be in contact with the surface (circumferential surface) of the photosensitive member 21 with a predetermined press amount against the photosensitive member 21. The development roller 23 is driven by a driving force transmitted from the photosensitive drum motor (not illustrated), to be rotated in the counterclockwise direction in this example. To the development roller 23, a predetermined development voltage is applied from the later-described high voltage power supply part 63.

The supply roller 24 is configured to supply the toner contained in the toner container 25 to the development roller 23. The supply roller 24 is provided to be in contact with the surface (circumferential surface) of the development roller 23 with a predetermined press amount against the development roller 23. The supply roller 24 is driven by a driving force from the photosensitive drum motor (not illustrated), to be rotated in the counterclockwise direction in this example. With this, a friction is occurred between the surface of the supply roller 24 and the surface of the development roller 23, and thus the toner is charged by a so-called friction charging. To the supply roller 24, a predetermined supply voltage is applied from the later-described high voltage power supply part 63.

Each of the four toner containers 25 (toner containers 25K, 25Y, 25M, and 25C) is configured to accommodate therein the toner. Specifically, the toner container 25K accommodates therein a black toner, the toner container 25Y accommodates therein a yellow toner, the toner container 25M accommodates therein a magenta toner, and the toner container 25C accommodates therein a cyan toner.

Each of the four exposure units 26 (exposure units 26K, 26Y, 26M, and 26C) emits light to the photosensitive member 21 of a corresponding one of the four image formation units 20. For example, each exposure unit 26 is configured to have a LED (Light Emitting Diode) head. The exposure unit 26K emits light to the photosensitive member 21 of the image formation unit 20K, the exposure unit 26Y emits light to the photosensitive member 21 of the image formation unit 20Y, the exposure unit 26M emits light to the photosensitive member 21 of the image formation unit 20M, and the exposure unit 26C emits light to the photosensitive member 21 of the image formation unit 20C. Thus, on the surfaces of the photosensitive drums 21 of the image formation units, electrostatic latent images are formed.

The transfer unit 30 is configured to transfer the toner images formed by the image formation units 20K, 20Y, 20M, and 20C, to a surface (transfer surface) of the recording medium 6. The transfer unit 30 includes a transfer belt 31 and four transfer rollers 32 (transfer rollers 32K, 32Y, 32M, and 32C). The transfer belt 31 is a member that conveys the recording medium 6 in the conveyance direction F along the conveyance path 7. Each of the four transfer rollers 32 is a member to transfer the toner image formed on the photosensitive member 21 of the corresponding image formation unit 20, to the transfer surface of the recording medium 6. The transfer roller 32K is disposed to be opposed to the photosensitive member 21 of the image formation unit 20K via the conveyance path 7 and the transfer belt 31. The transfer roller 32Y is disposed to be opposed to the photosensitive member 21 of the image formation unit 20Y via the conveyance path 7 and the transfer belt 31. The transfer roller 32M is disposed to be opposed to the photosensitive member 21 of the image formation unit 20M via the conveyance path 7 and the transfer belt 31. The transfer roller 32C is disposed to be opposed to the photosensitive member 21 of the image formation unit 20C via the conveyance path 7 and the transfer belt 31. To each of the transfer rollers 32K, 32Y, 32M, and 32C, the predetermined transfer voltage is applied from the later-described high voltage power supply part 63. With this, the image formation apparatus 1 transfers the toner image formed by each of the image formation units 20 to the transfer surface of the recording medium 6.

The fixation device 40 applies heat and pressure to the recording medium 6, to fix the toner images transferred onto the recording medium 6 to the recording medium 6.

Figure 2:
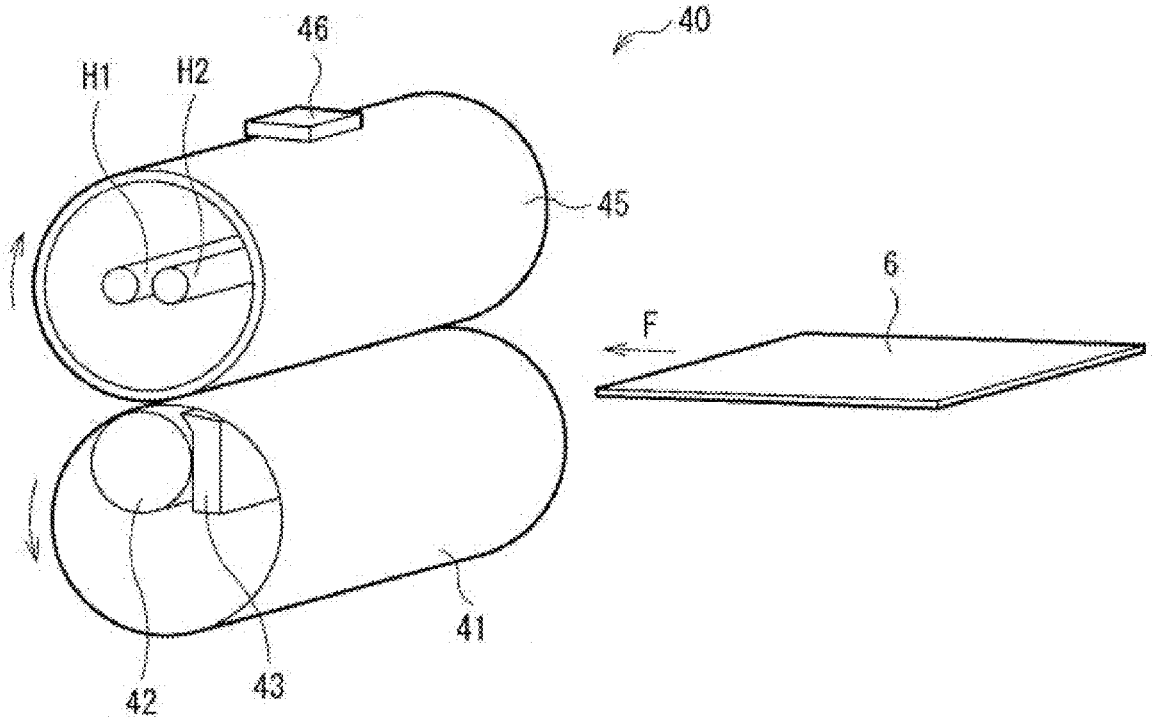
FIG. 2 is a diagram illustrating a view of an example of a configuration of a fixation device illustrated in FIG. 1.

FIG. 2 is a diagram illustrating a configuration example of the fixation device 40. The fixation device 40 includes a fixation belt 41, a fixation roller 42, a heating roller 45, a temperature sensor 46, a heater H1, and a heater H2. The fixation belt 41 is an elastic endless belt and is wound and stretched around the fixation roller 42, a pad 43, and a guide member (not illustrated). The fixation roller 42 and the heating roller 45 are disposed to form a nip portion (pressure contact portion) therebetween via the fixation belt 41, such that a pressure is applied to the toner transferred onto the recording medium 6. The heating roller 45 is configured to apply heat to the toner transferred onto the recording medium 6. The temperature sensor 46 is configured to detect a temperature of a surface of the heating roller 45. The temperature sensor 46 may be configured with a thermistor or the like, for example. The heaters H1 and H2 may be configured with, for example, a halogen heater, a ceramic heater, or the like, to be selected according to the size, thickness, or the like of the recording medium. The heater H2 has a heater power (an electric power) smaller than a heater power (an electric power) of the heater H1. In an embodiment, the heater power PW1 of the heater H1 is 1000 W, and the heater power PW2 of the heater H2 is 500 W, for example. With this configuration, the fixation device 40 heats to fuse and presses the toner on the recording medium 6. Thus, the toner images are fixed to the recording medium 6.

The conveyance rollers 17 include a pair of rollers that sandwiches the conveyance path 7. The conveyance rollers 18 include a pair of rollers that sandwiches the conveyance path 7. The conveyance rollers 17 and 18 are configured to convey the recording medium 6 along the conveyance path 7.

The discharge roller 19 includes a pair of rollers that sandwiches the conveyance path 7, and is configured to discharge the recording medium 6 out of the image formation apparatus 1.

Figure 3:
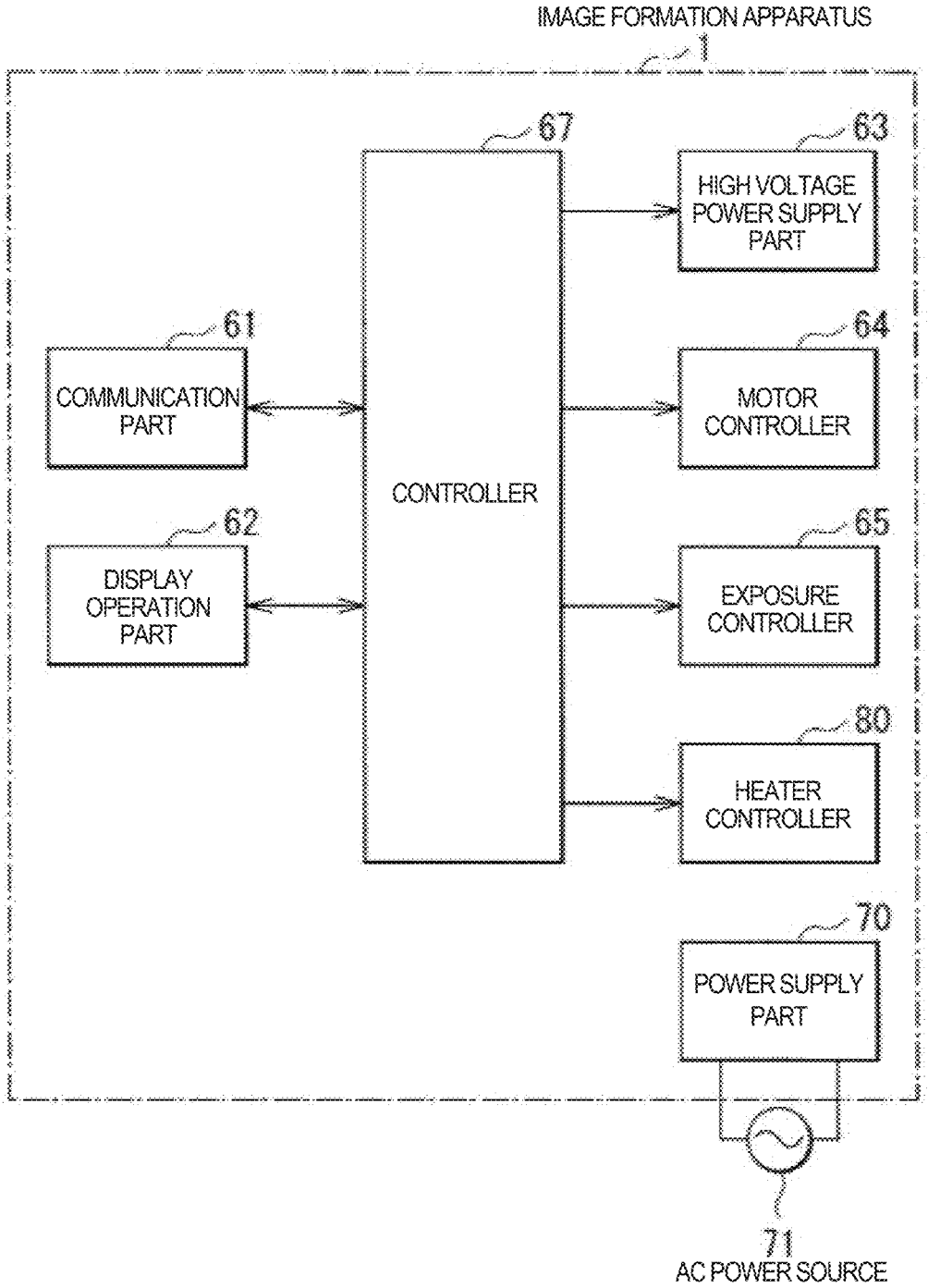
FIG. 3 is a block diagram illustrating a view of an example of a control-related configuration of the image formation apparatus, such as being illustrated in FIG. 1.

FIG. 3 is a diagram illustrating a view of an example of a control-related configuration of the image formation apparatus 1. The image formation apparatus 1 includes a communication part 61, a display operation part 62, a high voltage power supply part 63, a motor controller 64, an exposure controller 65, a heater controller 80, a power supply part 70, and a controller 67.

The communication part 61 is configured to execute communication by using a USB (Universal Serial Bus) or a LAN (Local Area Network), or the like. The communication part 61 receives print data transmitted from a computer (not illustrated), for example.

The display operation part 62 is configured with a touch panel, a liquid crystal display, and/or etc., and is configured to accept user operations and display the operating status or the like of the image formation apparatus 1.

The high voltage power supply part 63 is configured, based on instructions from the controller 67, to generate various high voltages to be used in the image formation apparatus 1, such as a charging voltage, a development voltage, a supply voltage, a transfer voltage, and the like.

The motor controller 64 is configured to control operations of various motors, such as the photosensitive drum motor (not illustrated) and the like, based on instructions from the controller 67.

The exposure controller 65 is configured to control exposure operations of the four exposure units 26 based on instructions from the controller 67.

The heater controller 80 is configured to control operations of the heaters H1 and H2 of the fixation device 40, based on instructions from the controller 67.

The power supply part 70 is configured to supply electric power to the heaters H1 and H2 based on an AC power supply signal VAC supplied from an AC power source 71 such as a commercial power source.

The controller 67 is configured to control operations of the image formation apparatus 1 by controlling operations of each block thereof. Specifically, for example, when the communication part 61 receives print data, the controller 67 controls the image formation apparatus 1 to perform an image formation operation. In the image formation operation, the controller 67 controls the operation of the high voltage power supply part 63 so that the high voltage power supply part 63 generates various high voltages, controls the operation of the motor controller 64 so that the motor controller 64 controls the operation of various motors, and controls the operation of the exposure controller 65 so that the exposure controller 65 controls the exposure operations of the four exposure units 26. Also, the controller 67 controls the operation of the heater controller 80 so that the heater controller 80 controls the operations of the heaters H1 and H2 of the fixation device 40. The controller 67 controls the operation of the display operation part 62 so that the display operation part 62 receives user operations (inputs) and displays the operation status or the like of the image formation apparatus 1. Functions of the controller 67 may be implemented by, for example, hardware and/or software.

Figure 4:
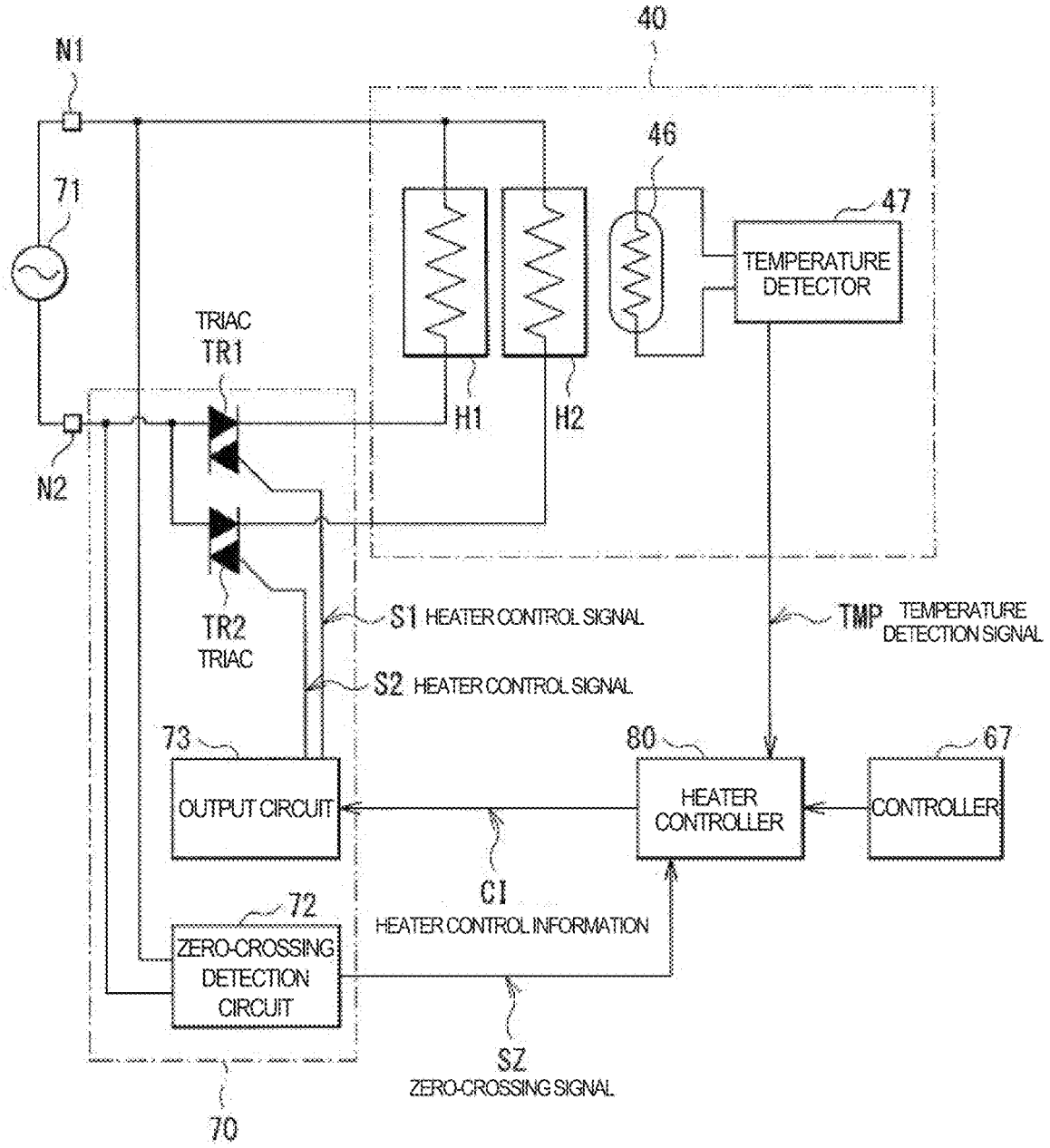
FIG. 4 is a circuit diagram illustrating an example of a configuration of a power supply part, such as being illustrated in FIG. 3.

FIG. 4 is a diagram illustrating a view of a configuration example of a part of the power supply part 70 and the fixation device 40. Note that FIG. 4 also illustrates the heater controller 80 and the controller 67 to facilitate explanation. The AC power source 71 is connected to power supply terminals N1 and N2 of the image formation apparatus 1.

The fixation device 40 includes a temperature detector 47, in addition to the heaters H1 and H2 and the temperature sensor 46. An end of the heater H1 is connected to the power supply terminal N1, and the other end of the heater H1 is connected to a later-described triac TR1 of the power supply 70. An end of the heater H2 is connected to the power supply terminal N1, and the other end of the heater H2 is connected to a later-described triac TR2 of the power supply 70. The temperature detector 47 is connected to the temperature sensor 46, and is configured to detect the temperature, based on the detection result of the temperature sensor 46. The temperature detector 47 generates, based on the detected temperature, the temperature detection signal TMP, and supplies the temperature detection signal TMP to the heater controller 80.

The heater controller 80 is configured to generate heater control information CI, which is control information on the operations of the heaters H1 and H2, based on an instruction from the controller 67, a zero-crossing signal SZ (described later), and the temperature detection signal TMP. The heater controller 80 is configured to supply the heater control information CI to an output circuit 73.

The power supply part 70 is configured to generate the zero-crossing signal SZ based on the power supply signal VAC and to supply the power supply signal VAC to the heaters H1 and H2 based on the heater control information CI. The power supply part 70 includes a zero-crossing detection circuit 72, the output circuit 73, and the triacs TR1 and TR2.

The zero-crossing detection circuit 72 is configured to generate the zero-crossing signal SZ by detecting a zero-crossing timing of the power supply signal VAC based on the AC power supply signal VAC supplied from the AC power source 71. For example, the zero-crossing signal SZ becomes a high level during a certain length of time period including the zero-cross timing of the power supply signal VAC, and becomes a low level in the other time periods. The zero-crossing detection circuit 72 outputs the generated zero-crossing signal SZ to the heater controller 80.

The output circuit 73 is configured to generate heater control signals S1 and S2 based on the heater control information CI supplied from the heater controller 80, supply the heater control signal S1 to the triac TR1, and supply the heater control signal S2 to the triac TR2.

Each of the triacs TR1 and TR2 is a semiconductor switching element that can be transitioned between an on-state and an off-state, and is configured to operate as an AC (Alternating Current) switch. The triac TR1 is arranged in a path connecting the power terminal N2 of the image formation apparatus 1 and the other end of the heater H1, in such a manner that the heater control signal S1 is supplied to a gate of the triac TR1. The triac TR1 is turned on and off based on the heater control signal S1. The triac TR1 supplies the power supply signal VAC to the heater H1 when the triac TR1 is the on-state, whereas the triac TR1 stops the supply of the power supply signal VAC to the heater H1 when the triac TR1 is the off-state. The triac TR2 is arranged in a path connecting the power supply terminal N2 of the image formation apparatus 1 and the other end of the heater H2, in such a manner that the heater control signal S2 is supplied to a gate of the triac TR2. The triac TR2 is turned on and off based on the heater control signal S2. The triac TR2 supplies the power supply signal VAC to the heater H2 when the triac TR2 is the on-state, whereas the triac TR2 stops the supply of the power supply signal VAC to the heater H2 when the triac TR2 is the off-state.

With this configuration, the heater controller 80 controls the operations of the heaters H1 and H2 of the fixation device 40 based on the instruction from the controller 67. Specifically, the heater controller 80 generates, based on the zero-crossing signal SZ and the temperature detection signal TMP, the heater control information CI, which is the control information for the operations of the heaters H1 and H2. The output circuit 73 generates the heater control signals S1 and S2 based on the heater control information CI, and supplies the heater control signal S1 to the triac TR1 and supplies the heater control signal S2 to the triac TR2. The triac TR1 is turned on or off based on the heater control signal S1. The triac TR1 supplies the power supply signal VAC to the heater H1 when the triac TR1 is in the on-state thereof. The triac TR2 is turned on or off based on the heater control signal S2. The triac TR2 supplies the power supply signal VAC to the heater H2 when the triac TR2 is in the on-state thereof. In this way, the heater controller 80 controls the supply of the power supply signal VAC to the heaters H1 and H2.

Here, the heater H1 may correspond to a specific example of a "first heater" in this disclosure. The heater H2 may correspond to a specific example of a "second heater" in this disclosure. The triac TR1 may correspond to a specific example of a "first switch" in this disclosure. Triac TR2 may correspond to a specific example of a "second switch" in this disclosure. The heater control signal S1 may correspond to a specific example of a "first control signal" in this disclosure. The heater control signal S2 may correspond to a specific example of a "second control signal" in this disclosure. The output circuit 73 and the heater controller 80 correspond to a specific example of a "heater controller" in this disclosure.

[Operations and Functions]

Next, operations and functions of the image formation apparatus 1 according to an embodiment are described below.

(Overview of Overall Operation)

First, with reference FIGS. 1 to 3, an overview of an overall operation of the image formation apparatus 1 is described below. When the communication part 61 receives print data, the controller 67 controls the image formation apparatus 1 to perform an image forming operation. In the image forming operation, the motor controller 64 controls, in response to an instruction(s) from the controller 67, the operations of the pick-up roller 11, the conveyance rollers 12 and 13, and the resist roller 14, so as to convey the recording medium 6 along the conveyance path 7. The motor controller 64 controls the operations of the various rollers in the four image formation units 20 by controlling the photosensitive drum motor (not shown) based on an instruction(s) from the controller 67. The exposure controller 65 controls the operations of the four exposure units 26 according to the print data based on an instruction(s) from the controller 67. The high voltage power supply part 63 generates, based on an instruction(s) from the controller 67, the charging voltage, the development voltage, and the supply voltage. Thereby, on the surface of the photosensitive member 21 of each of the image formation units 20, an electrostatic latent image is formed and then a toner image is formed in accordance with the electrostatic latent image. The high voltage power supply part 63 generates, based on an instruction from the controller 67, the transfer voltage. The motor controller 64 conveys (circulates) the transfer belt 31 based on an instruction from the controller 67. Thereby, the toner images are transferred from the image formation units 20 onto the transfer surface of the recording medium 6. The heater controller 80 heats the heaters H1 and H2 by controlling the supply of the power supply signal VAC to the heaters H1 and H2 based on an instruction(s) from the controller 67. Thus, the fixation device 40 heats to fuse and presses the toner on the recording medium 6, so that the image is fixed on the recording medium 6. Then, the motor controller 64 controls the operations of the conveyance rollers 17 and 18 and the discharge roller 19 based on an instruction(s) from the controller 67, so as to discharge the recording medium 6 having the image fixed thereto.

(Detailed Operation)

Next, an operation in which the heater controller 80 controls the supply of the power supply signal VAC to the heaters H1 and H2 is described in detail below.

The heater controller 80 generates the heater control information CI based on the zero-crossing signal SZ and the temperature detection signal TMP. Specifically, the temperature detector 47 of the fixation device 40 detects the temperature based on the detection result of the temperature sensor 46. The temperature detector 47 generates the temperature detection signal TMP based on the detected temperature and supplies the temperature detection signal TMP to the heater controller 80. In the power supply 70, the zero-crossing detection circuit 72 generates the zero-crossing signal SZ based on the power supply signal VAC and supplies the zero-crossing signal SZ to the heater controller 80. The heater controller 80 generates the heater control information CI based on the zero-crossing signal SZ and the temperature detection signal TMP. The heater controller 80 supplies the heater control information CI to the output circuit 73.

The output circuit 73 of the power supply part 70 generates the heater control signals S1 and S2 based on the heater control information CI. The output circuit 73 supplies the heater control signal S1 to the triac TR1 and supplies the heater control signal S2 to the triac TR2.

The triac TR1 is turned on or off based on the heater control signal S1. The triac TR1 supplies the power supply signal VAC to the heater H1 when the triac TR1 is in the on-state, and stops the supply of the signal VAC to the heater H1 when the triac TR1 is in the off-state. Similarly, the triac TR2 is turned on or off based on the heater control signal S2. The triac TR2 supplies the power supply signal VAC to the heater H2 when the triac TR2 is in the on-state, and stops the supply of the signal VAC to the heater H2 when the triac TR2 is in the off-state.

Here, an example of a basic operation of a normal triac (triac TR) is described below. Like an embodiment illustrated in FIG. 4, the triac TR is connected to a heater H and controls (switches) supply of a power supply signal VAC to the heater H based on a heater control signal S.

Figure 5:
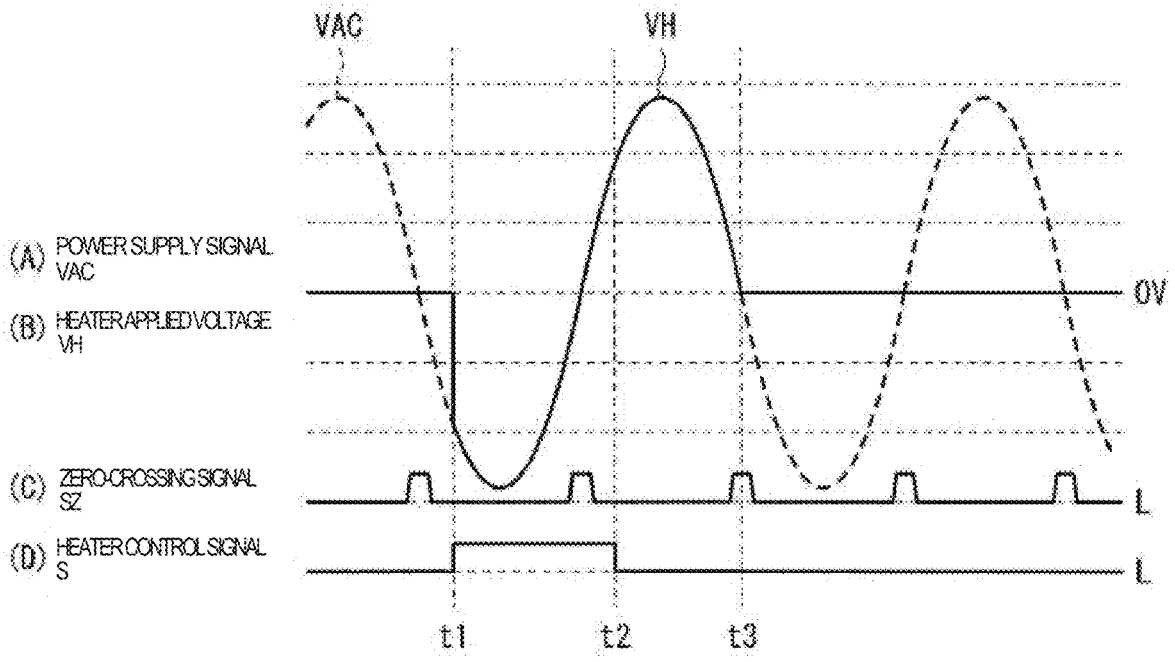
FIG. 5 is a timing diagram illustrating an operation example of a triac, such as being illustrated in FIG. 4.

FIG. 5 illustrates an operation example of the triac TR. In FIG. 5, a waveform (A) is a waveform of the power supply signal VAC, a waveform (B) is a waveform of a voltage (heater applied voltage VH) applied to the heater H, a waveform (C) is a waveform of a zero-crossing signal SZ, and a waveform (D) is a waveform of the heater control signal S. In this example, the waveform of the power supply signal VAC is a sine wave with a frequency of 50 Hz, for example. Note that the frequency of the power supply signal VAC is 50 Hz in this example, however it is not limited to this and may be 60 Hz or the like, for example. As illustrated in the waveform (C) in FIG. 5, the zero-crossing detection circuit generates the zero-crossing signal SZ whose level becomes high in a certain length of time period including the zero-crossing timing of the power supply signal VAC and whose level becomes low in the other time periods Before time t1, the heater control signal S is in a low level (see FIG. 5(D)). Thus, before time t1, the triac TR is in the off-state, and the power supply signal VAC is not supplied to the heater H.

At the time t1, the heater control signal S is changed from the low level to the high level (see FIG. 5(D)). Accordingly, the triac TR is transitioned from the off-state to the on-state, and thus the power supply signal VAC is supplied to the heater H (see FIG. 5(B)).

Next, at the time t2, the heater control signal S is changed from the high level to the low level (see FIG. 5(D)). From the time t2 to the time when the power supply signal VAC becomes 0V for the first time after the time t2, the triac TR is maintained in the on-state, which maintains the supply of the power supply signal VAC to the heater H (see FIG. 5(B)).

Next, at the time t3, the power supply signal VAC becomes 0V, that is, the voltage of the power supply signal VAC transitions from a positive voltage to a negative voltage (see FIG. 5(A)). Thus, the triac TR is transitioned from the on-state to the off-state, which stops the supply of the power supply signal VAC to the heater H, and thus the heater applied voltage VH becomes 0V (see FIG. 5(B)). Around the time t3 when the power supply signal VAC becomes 0V, the zero-crossing signal SZ becomes the high level.

As described above, at the time when the power supply signal VAC becomes 0V for the first time after the heater control signal S is changed from the high level to the low level, the triac TR is transitioned from the on-state to the off-state. In this example, since the frequency of the power supply signal VAC is 50 Hz, a time length from the timing when the heater control signal S is changed to the low level to the timing when the triac TR is transitioned to the off-state may be 10 milliseconds at the maximum.

Next, specific examples of operations of controlling the heaters H1 and H2 by the heater controller 80 are described in detail below. Since the heater electric power PW1 of the heater H1 is 1000 W and the heater electric power PW2 of the heater H2 is 500 W, the heater controller 80 can set the total (the total heater electric power PW) of the heater electric power PW1 and the heater electric power PW2 to 0 W, 500 W, 1000 W, and 1500 W. Power change controls of the total heater electric power PW are described in detail with examples below.

(Power Change Control Between 0 W and 500 W)

Figure 6:
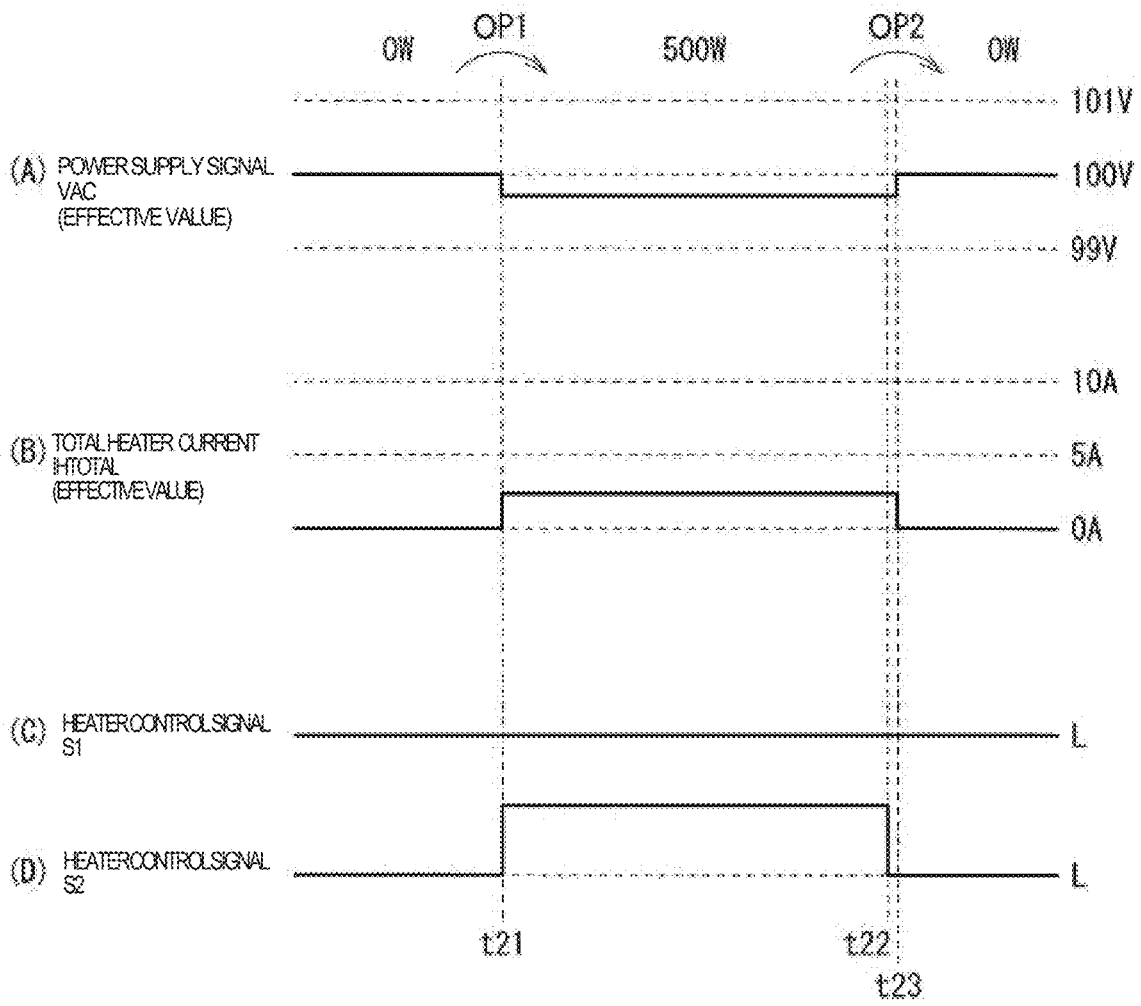
FIG. 6 is another timing diagram illustrating an operation example of the power supply part, such as being illustrated in FIG. 4.

FIG. 6 illustrates an operation example of controlling to change the total heater electric power PW from 0 W to 500 W and from 500 W to 0 W. In FIGS. 6 to 11, a waveform (A) is a waveform of an effective value of the power supply signal VAC, a waveform (B) is a waveform of an effective value of a total heater electric current IHtotal, which is a total (sum) of a heater electric current IH1 flowing through the heater H1 and a heater electric current IH2 flowing through the heater H2, a waveform (C) is a waveform of the heater control signal S1, and a waveform (D) is a waveform of the heater control signal S2. FIG. 6 illustrates the waveforms in a time period of few seconds. In this example, as illustrated in the waveform (C) of FIG. 6, the heater control signal S1 is maintained in the low level in this operation. That is, the heater H1 is maintained in a de-energized state.

First, the heater controller 80 executes control to change the total heater electric power PW from 0 W to 500 W. Specifically, the heater controller 80 executes an operation OP1 to change from a state where the triacs TR1 and TR2 are both off to a state where the triac TR1 is off and the triac TR2 is on.

In FIG. 6, the operation starts from a state where the heater H1 and the heater H2 are both de-energized. That is, first, the total heater electric power PW is 0 W. At time t21, the heater control signal S2 is changed from the low level to the high level (see FIG. 6(D)), and in response to this, the triac TR2 is transitioned from the off-state to the on-state. With this, the triac TR2 starts to supply the power supply signal VAC to the heater H2, and the effective value of the total heater electric current IHtotal increases (see FIG. 6(B)). With this, the power supply signal VAC has a voltage drop, and thus the effective value of the power supply signal VAC drops from 100V (see FIG. 6(A)). In this way, the heater controller 80 starts energizing the heater H2, so that the total heater electric power PW becomes 500 W. That is, in the operation OP1, the total heater electric power PW is changed from 0 W to 500 W directly.

Next, the heater controller 80 executes control to change the total heater electric power PW from 500 W to 0 W. Specifically, the heater controller 80 executes an operation OP2 to change from the state where the triac TR1 is off and the triac TR2 is on to the state where the triac TR1 and the triac TR2 are both off.

Since time t21, the heater H2 has been energized. That is, first, the total heater electric power PW is 500 W. At time t22 after time t21, the heater control signal S2 is changed from the high level to the low level (FIG. 6(D)). In response to this, at time t23 when the power supply signal VAC becomes 0V for the first time after the time t22, the triac TR2 is transitioned from the on-state to the off-state. With this, the triac TR2 stops the supply of the power supply signal VAC to the heater H2, and the effective value of the total heater electric current IHtotal drops (FIG. 6(B)). With this, the voltage drop occurred in the power supply signal VAC is resolved, so that the effective value of the power supply signal VAC rises to 100V (FIG. 6(A)). In this way, the heater controller 80 stops energizing the heater H2, so that the total heater electric power PW becomes 0 W. As described above, in the operation OP2, the total heater electric power PW is changed from 500 W to 0 W directly.

(Power Change Control Between 500 W and 1000 W)

Figure 7:
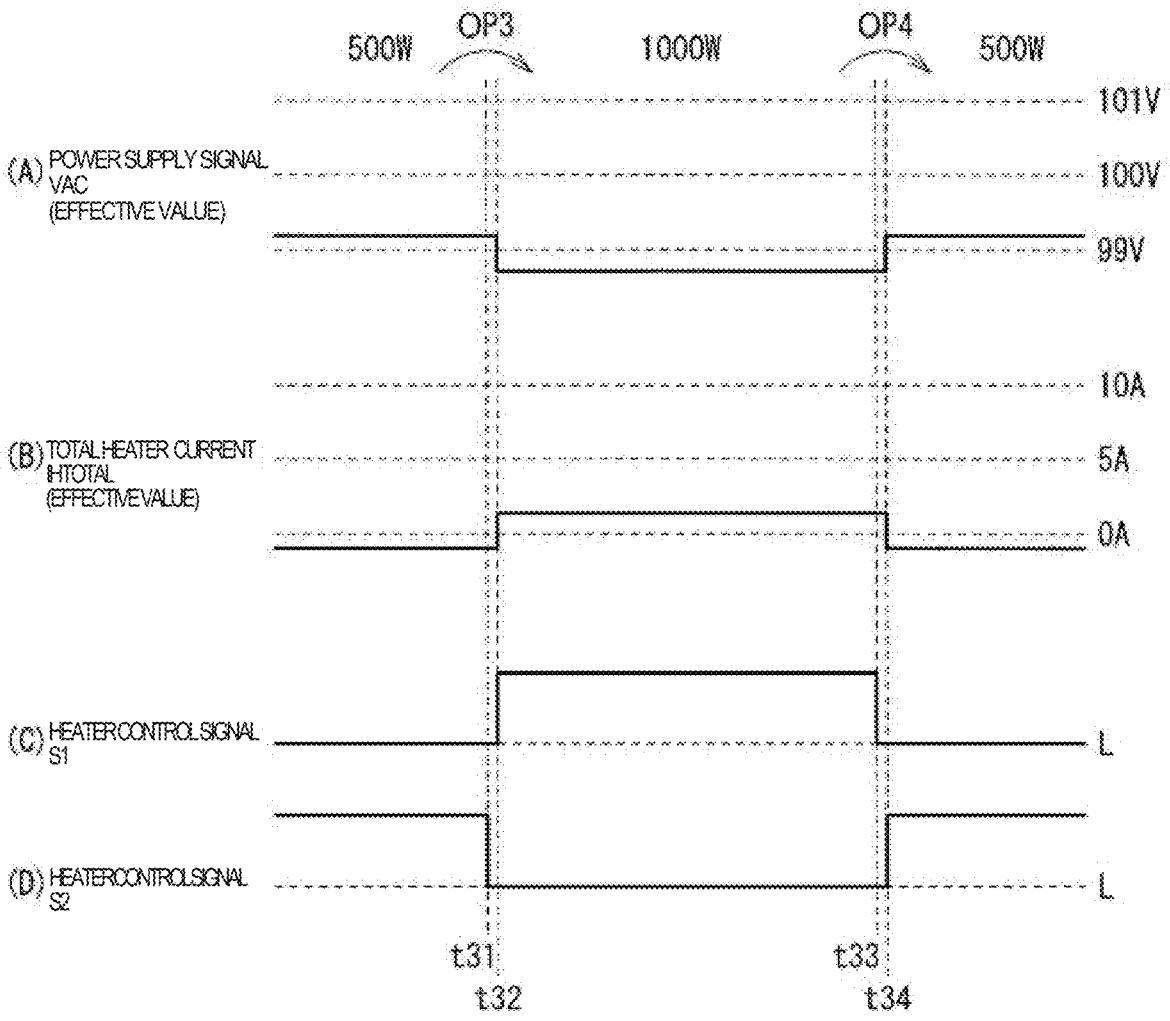
FIG. 7 is another timing diagram illustrating an operation example of the power supply part, such as being illustrated in FIG. 4.

FIG. 7 illustrates an operation example of controlling the total heater electric power PW from 500 W to 1000 W and from 1000 W to 500 W.

First, the heater controller 80 executes an operation of controlling to change the total heater electric power PW from 500 W to 1000 W. Specifically, the heater controller 80 executes an operation OP3 to change from the state where the triac TR1 is off and the triac TR2 is on to the state where the triac TR1 is on and the triac TR2 is off.

In FIG. 7, the operation starts from a state where the heater H1 is de-energized on and the heater H2 is energized. That is, first, the total heater electric power PW is 500 W. At time t31, the heater control signal S2 is changed from the high level to the low level (FIG. 7(D)). In response to this, at time t32 when the power supply signal VAC becomes 0V for the first time after time t31, the triac TR2 is transitioned from the on-state to the off-state. With this, the triac TR2 stops the supply of the power supply signal VAC to the heater H2. Also, at time t32, the heater control signal S1 is changed from the low level to the high level in synchronization with the zero-crossing signal SZ (FIG. 7(C)). In response to this, the triac TR1 is transitioned from the off-state to the on-state. That is, in this example, based on heater control information CI supplied from the heater controller 80, the output circuit 73 changes the heater control signal S1 at the timing synchronized with the zero-crossing signal SZ. Note that in a modification, the transition timing of the heater control signal S1 may not be synchronized with the zero-crossing signal SZ. With this operation, the triac TR1 starts the supply of the power supply signal VAC to the heater H1. The stopping of the supply of the power supply signal VAC to the heater H2 and the starting of the supply of the power supply signal VAC to the heater H1 cause a rise in the effective value of the total heater electric current IHtotal (FIG. 7(B)). With this, the voltage drop amount of the power supply signal VAC is increased, and thus the effective value of the power supply signal VAC drops (FIG. 7(A)). In this way, the heater controller 80 stops energizing the heater H2 and starts energizing the heater H1, so that the total heater electric power PW becomes 1000 W. As described above, in the operation OP3, the total heater electric power PW is changed from 500 W to 1000 W directly.

Next, the heater controller 80 executes control to change the total heater electric power PW from 1000 W to 500 W. Specifically, the heater controller 80 executes an operation OP4 to change from the state where the triac TR1 is on and the triac TR2 is off to the state where the triac TR1 is off and the triac TR2 is on.

Since time t32, the heater H1 has been energized. That is, first, the total heater electric power PW is 1000 W. At time t33 after time t32, the heater control signal S1 is changed from the high level to the low level (FIG. 7(C)). In response to this, at time t34 when the power supply signal VAC becomes 0V for the first time after time t33, the triac TR1 is transitioned from the on-state to the off-state. With this, the triac TR1 stops the supply of the power supply signal VAC to the heater H1. Also at time t34, the heater control signal S2 is changed from the low level to the high level at the timing synchronized with the zero-crossing signal SZ (FIG. 7(D)), so that the triac TR2 is transitioned from the off-state to the on-state and thus the triac TR2 starts the supply of the power supply signal VAC to the heater H2. The stopping of the supply of the power supply signal VAC to the heater H1 and the starting of the supply of the power supply signal VAC to the heater H2 cause the effective value of the total heater electric current IHtotal to drop (FIG. 7(B)). With this, the voltage drop amount of the power supply signal VAC is decreased, and thus the effective value of the power supply signal VAC rises (FIG. 7(A)). In this way, the heater controller 80 stops energizing the heater H1 and starts energizing the heater H2, so that the total heater electric power PW becomes 500 W. As described above, in the operation OP4, the total heater electric power PW is changed from 1000 W to 500 W directly.

(Power Change Control Between 1000 W and 1500 W)

Figure 8:
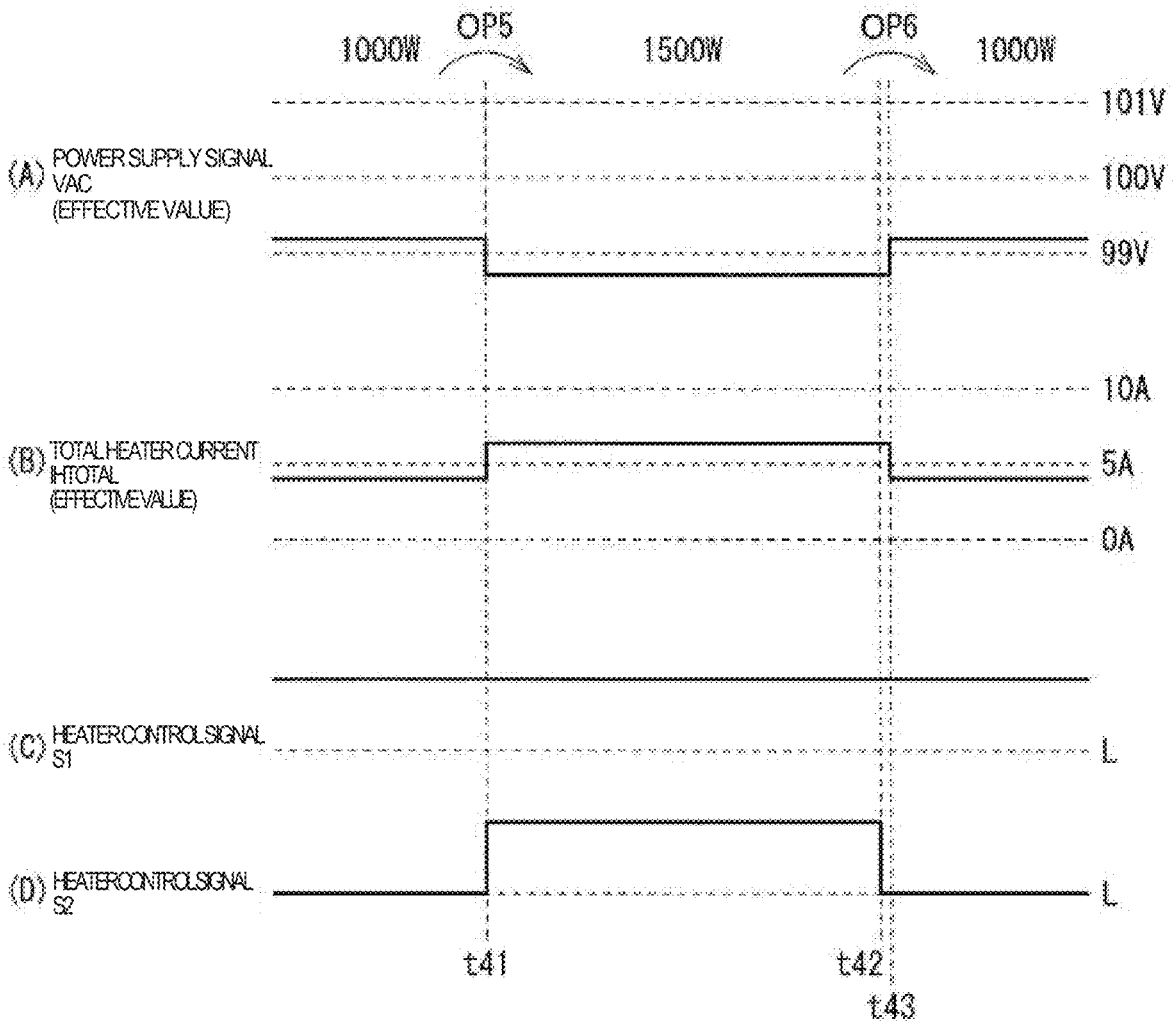
FIG. 8 is another timing diagram illustrating an operation example of the power supply part, such as being illustrated in FIG. 4.

FIG. 8 illustrates an operation example of controlling to change the total heater electric power PW from 1000 W to 1500 W and from 1500 W to 1000 W. As illustrated in waveform (C) of FIG. 8, the heater control signal S1 is maintained in the high level in this operation. That is, the heater H1 is maintained to be energized.

First, the heater controller 80 executes control to change the total heater electric power PW from 1000 W to 1500 W. Specifically, the heater controller 80 executes an operation OP5 to change from the state where the triac TR1 is on and the triac TR2 is off to the state where the triac TR1 and the triac TR2 are both on.

In FIG. 8, the operation starts from the state where the heater H1 is energized and the heater H2 is de-energized. That is, first, the total heater electric power PW is 1000 W.

At time t41, the heater control signal S2 is changed from the low level to the high level (FIG. 8(D)), and in response to this, the triac TR2 is transitioned from the off-state to the on-state. With this, the triac TR2 starts the supply of the power supply signal VAC to the heater H2, so that the effective value of the total heater electric current IHtotal rises (FIG. 8(B)). With this, the voltage drop amount of the power supply signal VAC is increased, and thus the effective value of the power supply signal VAC drops (FIG. 8(A)). In this way, the heater controller 80 starts energizing the heater H2, so that the total heater electric power PW becomes 1500 W. As described above, in the operation OP5, the total heater electric power PW is changed from 1000 W to 1500 W directly.

Next, the heater controller 80 executes control to change the total heater electric power PW from 1500 W to 1000 W. Specifically, the heater controller 80 executes an operation OP6 to change from the state where the triac TR1 and the triac TR2 are both on to the state where the triac TR1 is on and the triac TR2 is off.

Since time t41, the heater H1 and the heater H2 have been energized. That is, first, the total heater electric power PW is 1500 W. At time t42 after time t41, the heater control signal S2 is changed from the high level to the low level (FIG. 8(D)). In response to this, at time t43 when the power supply signal VAC becomes 0V for the first time after the time t42, the triac TR2 is transitioned from the on-state to the off-state. With this, the triac TR2 stops the supply of the power supply signal VAC to the heater H2, and thus the effective value of the total heater electric current IHtotal drops (FIG. 8(B)). With this, the voltage drop amount of the power supply signal VAC is decreased, and thus the effective value of the power supply signal VAC rises (FIG. 8(A)). In this way, the heater controller 80 stops energizing the heater H2, so that the total heater electric power PW becomes 1000 W. As described above, in the operation OP6, the total heater electric power PW is changed from 1500 W to 1000 W directly.

(Power Change Control Between 0 W and 1000 W)

Figure 9:
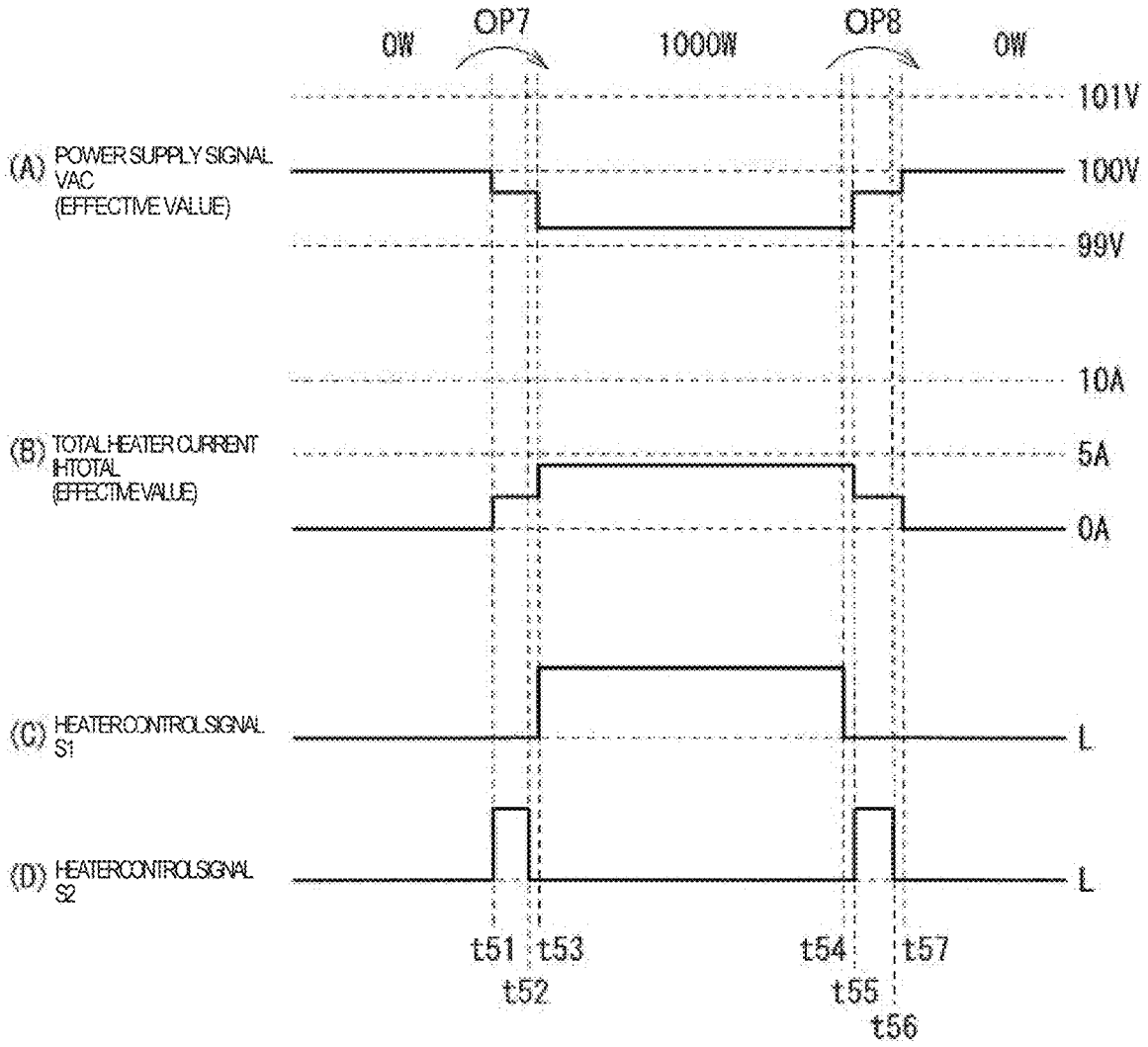
FIG. 9 is another timing diagram illustrating an operation example of the power supply part, such as being illustrated in FIG. 4.

FIG. 9 illustrates an operation example of controlling to change the total heater electric power PW from 0 W to 1000 W and from 1000 W to 0 W.

First, the heater controller 80 executes control to change the total heater electric power PW from 0 W to 1000 W. Specifically, the heater controller 80 executes an operation OP7 to change from the state where the triac TR1 and the triac TR2 are both off to the state where the triac TR1 is on and the triac TR2 is off. Here the operation OP7 may be to a specific example of a "second operation" in this disclosure.

In FIG. 9, the operation starts from the state where the heater H1 and the heater H2 are both de-energized. That is, first, the total heater electric power PW is 0 W. At time t51, the heater control signal S2 is changed from the low level to the high level (FIG. 9(D)). In response to this, the triac TR2 is transitioned from the off-state to the on-state. With this, the triac TR2 starts the supply of the power supply signal VAC to the heater H2, and thus the effective value of the total heater electric current IHtotal rises (FIG. 9(B)). With this, the voltage drop of the power supply signal VAC occurs, and thus the effective value of the power supply signal VAC drops from 100V (FIG. 9(A)).

At time t52 after time t51, the heater control signal S2 is changed from the high level to the low level (FIG. 9(D)). In response to this, at the time t53 when the power supply signal VAC becomes 0V for the first time after time t52, the triac TR2 is transitioned from the on-state to the off-state. With this, the triac TR2 stops the supply of the power supply signal VAC to the heater H2. Also, at time t53, the heater control signal S1 is changed, at the timing synchronized with the zero-crossing signal SZ, from the low level to the high level (FIG. 9(C)), and in response to this, the triac TR1 is transitioned from the off-state to the on-state. With this, the triac TR1 starts the supply of the power supply signal VAC to the heater H1. The stopping of the supply of the power supply signal VAC to the heater H2 and the starting of the supply of the power supply signal VAC to the heater H1 cause the effective value of the total heater electric current IHtotal to rise (FIG. 9(B)). With this, the voltage drop amount of the power supply signal VAC is increased and thus the effective value of the power supply signal VAC drops (FIG. 9(A)). In this way, in the operation OP7, the heater controller 80 controls the heaters H1 and H2 to transition to a transient state where the heater H1 is not energized and the heater H2 is energized, and then to start energizing the heater H1. That is, the total heater electric power PW is changed from 0 W to 500 W, and then to 1000 W. Accordingly, in the operation OP7, the total heater electric power PW is changed from 0 W to 1000 W in a stepwise manner.

Next, the heater controller 80 executes control to change the total heater electric power PW from 1000 W to 0 W. Specifically, the heater controller 80 executes an operation OP8 to change from the state where the triac TR1 is on and the triac TR2 is off to the state where the triac TR1 and the triac TR2 are both off.

Since time t53, the heater H1 has been energized and the heater H2 has been de-energized. That is, first, the total heater electric power PW is 1000 W. At time t54 after time t53, the heater control signal S1 is changed from the high level to the low level (FIG. 9(C)). In response to this, at time t55 when the power supply signal VAC becomes 0V for the first time after the time t54, the triac TR1 is transitioned from the on-state to the off-state. With this, the triac TR1 stops the supply of the power supply signal VAC to the heater H1. Also, at time t55, the heater control signal S2 is changed from the low level to the high level at the timing synchronized with the zero-crossing signal SZ (FIG. 9(D)), and in response to this, the triac TR2 is transitioned from the off-state to the on-state. With this, the triac TR2 starts the supply of the power supply signal VAC to the heater H2. The stopping of the supply of the power supply signal VAC to the heater H1 and the starting of the supply of the power supply signal VAC to the heater H2 cause the effective value of the total heater electric current IHtotal to drop (FIG. 9(B)). With this, the voltage drop amount of the power supply signal VAC is decreased, and thus the effective value of the power supply signal VAC rises (FIG. 9(A)).

At time t56 after time t55, the heater control signal S2 is changed from the high level to the low level (FIG. 9(D)). In response to this, at time t57 when the power supply signal VAC becomes 0V for the first time after the time t56, the triac TR2 is transitioned from the on-state to the off-state. With this, the triac TR2 stops the supply of the power supply signal VAC to the heater H2, and thus the effective value of the total heater electric current IHtotal drops (FIG. 9(B)). With this, the voltage drop occurred in the power supply signal VAC is resolved, and thus the effective value of the power supply signal VAC rises to 100V (FIG. 9(A)). In this way, in the operation OP8, the heater controller 80 controls the heaters H1 and H2 to transition to a transient state where the heater H1 is not energized and the heater H2 is energized, and then stop energizing the heater H2.

That is, the total heater electric power PW is changed from 1000 W to 500 W, and then to 0 W. Accordingly, in the operation OP8, the total heater electric power PW is changed from 1000 W to 0 W in a stepwise manner.

Here, a period from time t51 to time t53 and a period from time t55 to time t57 may be set, for example, to a time length equal to or greater than a predetermined time length T0. The predetermined time length T0 may be set to 100 milliseconds, for example. With this, the image formation apparatus 1 can mitigate an abrupt change in the power supply signal VAC. Thus, a people(s) near or under a lighting device connected to the AC power source 71 may be less likely to recognize a sudden change in the brightness of the lighting device. As a result, it is possible to reduce the possibility that the people(s) may feel flickers.

(Power Change Control Between 500 W and 1500 W)

Figure 10:
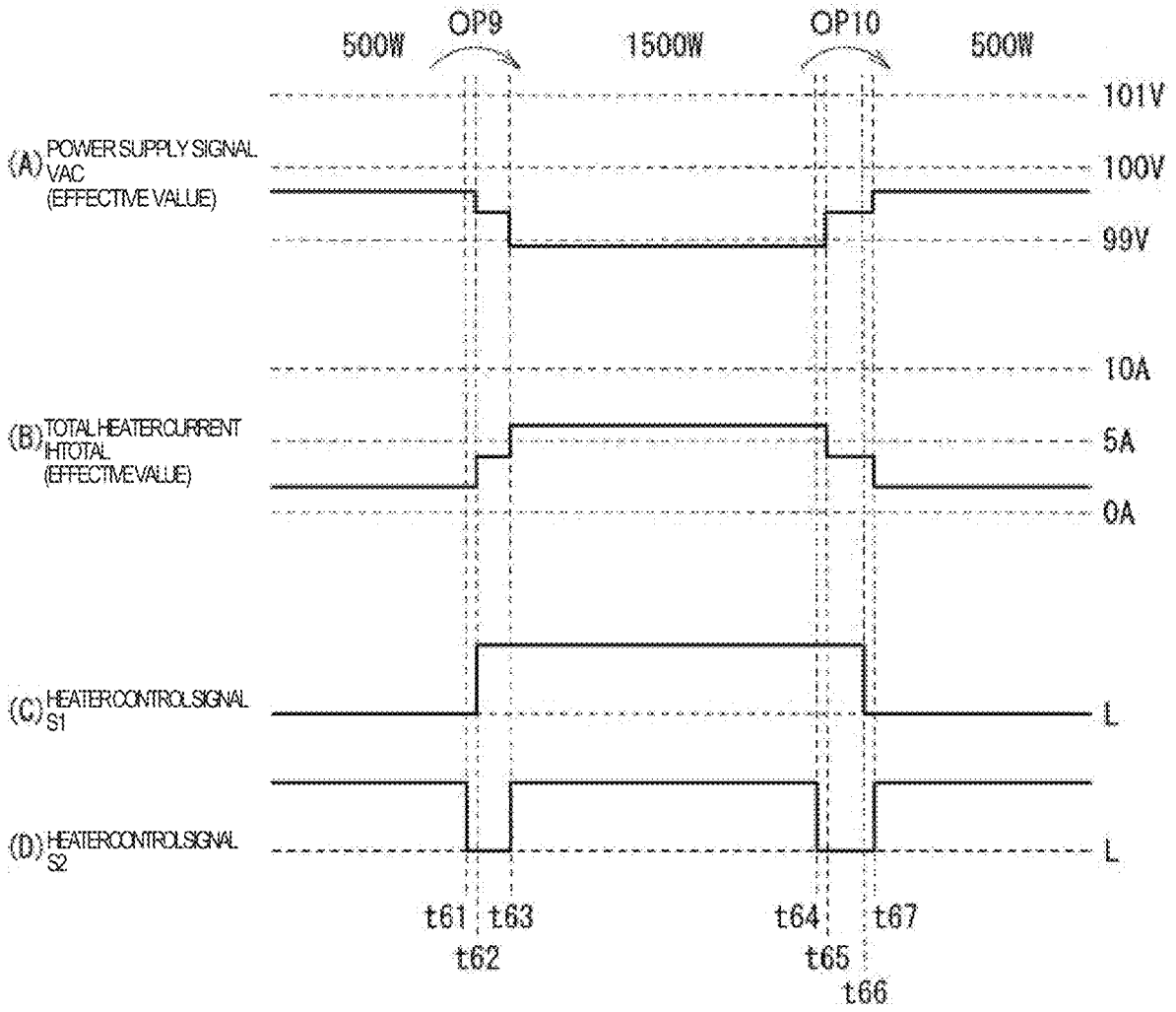
FIG. 10 is another timing diagram illustrating an operation example of the power supply part, such as being illustrated in FIG. 4.

FIG. 10 illustrates an operation example of controlling to change the total heater electric power PW from 500 W to 1500 W and from 1500 W to 500 W.

First, the heater controller 80 executes control to change the total heater electric power PW from 500 W to 1500 W. Specifically, the heater controller 80 executes an operation OP9 to change from the state where the triac TR1 is off and the triac TR2 is on to the state where the triac TR1 and the triac TR2 are both on. Here the operation OP9 may be a specific example of a "third operation" in this disclosure.

In FIG. 10, the operation starts from the state where the heater H1 is de-energized and the heater H2 is energized. That is, first, the total heater electric power PW is 500 W. At time t61, the heater control signal S2 is changed from the high level to the low level (FIG. 10(D)). In response to this, at the time t62 when the power supply signal VAC becomes 0V for the first time after time t61, the triac TR2 is transitioned from the on-state to the off-state and thus the triac TR2 stops the supply of the power supply signal VAC to the heater H2. Also, at time t62, the heater control signal S1 is changed from the low level to the high level in synchronization with the zero-crossing signal SZ (FIG. 10(C)), and in response to this, the triac TR1 is transitioned from the off-state to the on-state. With this, the triac TR1 starts the supply of the power supply signal VAC to the heater H1. The stopping of the supply of the power supply signal VAC to the heater H2 and the starting of the supply of the power supply signal VAC to the heater H1 cause the effective value of the total heater electric current IHtotal to rise (FIG. 10(B)). With this, the voltage drop amount of the power supply signal VAC is increased, and thus the effective value of the power supply signal VAC drops (FIG. 10(A)).

At time t63 after time t62, the heater control signal S2 is changed from the low level to the high level (FIG. 10(D)), and in response to this, the triac TR2 is transitioned from the off-state to the on-state. With this, the triac TR2 starts the supply of the power supply signal VAC to the heater H2, and thus the effective value of the total heater electric current IHtotal rises. With this, the voltage drop amount of the power supply signal VAC is increased, and thus the effective value of the power supply signal VAC drops (FIG. 10(A)). As described above, in the operation OP9, the heater controller 80 controls the heaters H1 and H2 to transition to a transient state where the heater H1 is energized and the heater H2 is de-energized, and then to start energizing the heater H2. That is, the total heater electric power PW is changed from 500 W to 1000 W, and then to 1500 W. Accordingly, in the operation OP9, the total heater electric power PW is changed from 500 W to 1500 W in a stepwise manner.

Next, the heater controller 80 executes control to change the total heater electric power PW from 1500 W to 500 W. Specifically, the heater controller 80 executes an operation OP10 to change from the state where the triac TR1 and the triac TR2 are both on to the state where the triac TR1 is off and the triac TR2 is on.

Since time t63, the heater H1 and the heater H2 have been energized. That is, first, the total heater electric power PW is 1500 W. At time t64 after time t63, the heater control signal S2 is changed from the high level to the low level (FIG. 10(D)). In response to this, at time t65 when the power supply signal VAC becomes 0V for the first time after the time t64, the triac TR2 is transitioned from the on-state to the off-state. With this, the triac TR2 stops the supply of the power supply signal VAC to the heater H2, and thus the effective value of the total heater electric current IHtotal drops (FIG. 10(B)). With this, the voltage drop amount of the power supply signal VAC is decreased, and thus the effective value of the power supply signal VAC rises (FIG. 10(A)).

At time t66 after time t65, the heater control signal S1 is changed from the high level to the low level (FIG. 10(C)). In response to this, at time t67 when the power supply signal VAC becomes 0V for the first time after the time t66, the triac TR1 is transitioned from the on-state to the off-state. With this, the triac TR1 stops the supply of the power supply signal VAC to the heater H1. Also, at time t67, the heater control signal S2 is changed from the low level to the high level in synchronization with the zero-crossing signal SZ (FIG. 10(D)), and in response to this, the triac TR2 is transitioned from the off-state to the on-state. With this, the triac TR2 starts the supply of the power supply signal VAC to the heater H2. The stopping of the supply of the power supply signal VAC to the heater H1 and the starting of the supply of the power supply signal VAC to the heater H2 cause the effective value of the total heater electric current IHtotal to drop (FIG. 10(B)). With this, the voltage drop amount of the power supply signal VAC is decreased, and thus the effective value of the power supply signal VAC rises (FIG. 10(A)). In this way, in the operation OP10, the heater controller 80 controls the heaters H1 and H2, to transition to a transient state where the heater H1 is energized and the heater H2 is de-energized, and then to stop energizing the heater H1 and start energizing the heater H2. That is, the total heater electric power PW is changed from 1500 W to 1000 W, and then to 500 W. Accordingly, in the operation OP10, the total heater electric power PW is changed from 1500 W to 500 W in a stepwise manner.

Here, a period from time t62 to time t63 and a period from time t65 to time t67 may be set, for example, to a time length equal to or greater than the predetermined time length T0 (100 milliseconds, for example).

(Power Change Control Between 0 W and 1500 W)

Figure 11:
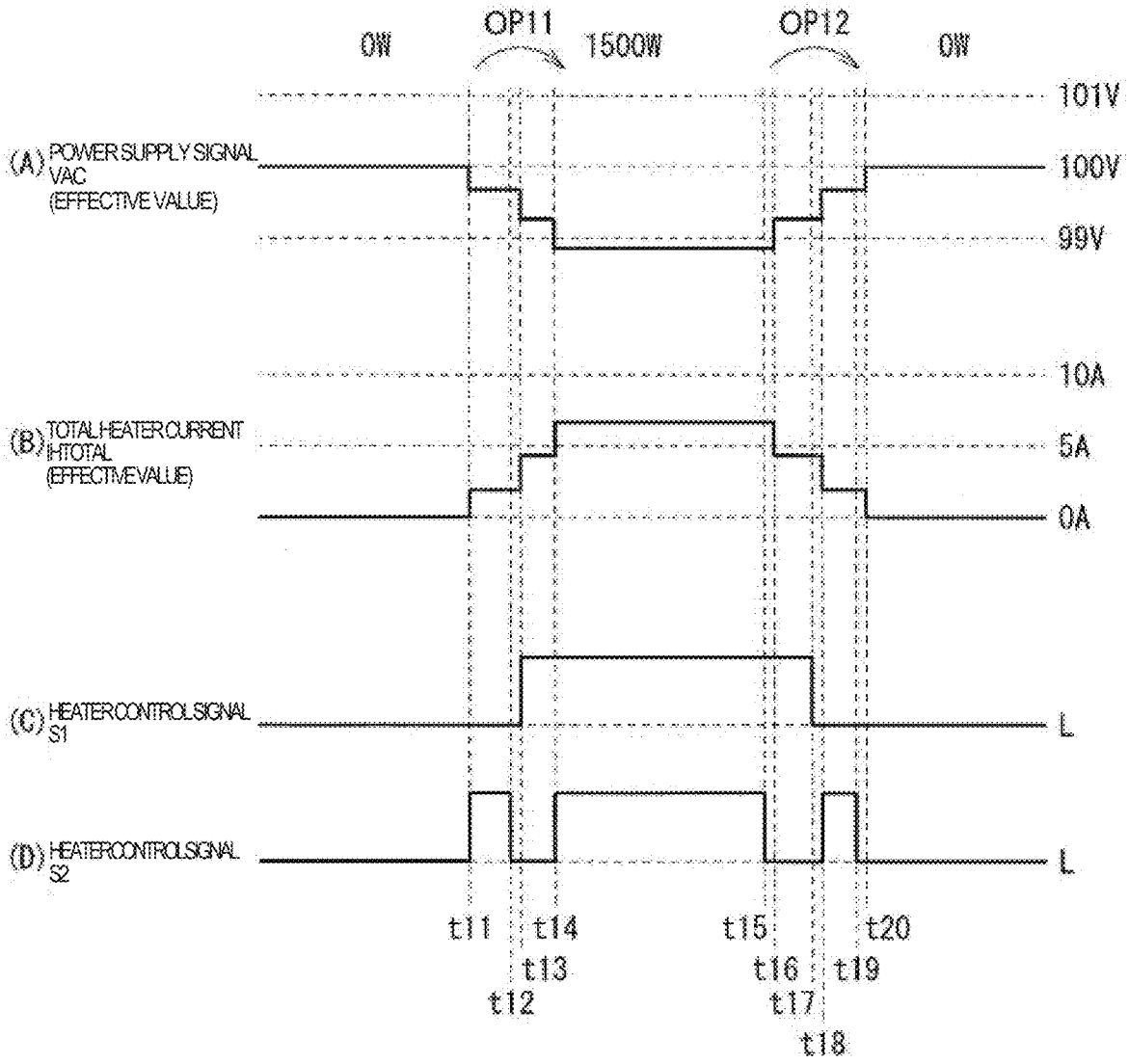
FIG. 11 is another timing diagram illustrating an operation example of the power supply part, such as being illustrated in FIG. 4.

FIG. 11 illustrates an operation example of controlling the total heater electric power PW from 0 W to 1500 W and from 1500 W to 0 W.

First, the heater controller 80 executes control to change the total heater electric power PW from 0 W to 1500 W. Specifically, the heater controller 80 executes an operation OP11 to transit the state where the triac TR1 and the triac TR2 are both off to the state where the triac TR1 and the triac TR2 are both on. Here, the operation OP11 may be a specific example of a "first operation" in this disclosure.

In FIG. 11, the operation starts from the state where the heater H1 and the heater H2 are both de-energized. That is, first, the total heater electric power PW is 0 W. At time t11, the heater control signal S2 is changed from the low level to the high level (FIG. 11(D)), and in response to this, the triac TR2 is transitioned from the off-state to the on-state. With this, the triac TR2 starts the supply of the power supply signal VAC to the heater H2, and thus the effective value of the total heater electric current IHtotal rises (FIG. 11(B)). With this, the voltage drop occurs in the power supply signal VAC, and thus the effective value of the power supply signal VAC drops from 100V (FIG. 11(A)).

At time t12 after time t11, the heater control signal S2 is changed from the high level to the low level (FIG. 11(D)). In response to this, at time t13 when the power supply signal VAC becomes 0V for the first time after the time t12, the triac TR2 is transitioned from the on-state to the off-state. With this, the triac TR2 stops the supply of the power supply signal VAC to the heater H2. Also, at time t13, the heater control signal S1 is changed, in synchronization with the zero-crossing signal SZ, from the low level to the high level (FIG. 11(C)). In response to this, the triac TR1 is transitioned from the off-state to the on-state, and thus the triac TR1 starts the supply of the power supply signal VAC to the heater H1. The stopping of the supply of the power supply signal VAC to the heater H2 and the starting of the supply of the power supply signal VAC to the heater H1 cause the effective value of the total heater electric current IHtotal to rise (FIG. 11(B)). With this, the voltage drop amount of the power supply signal VAC is increased, and thus the effective value of the power supply signal VAC drops (FIG. 11(A)).

At time t14 after time t13, the heater control signal S2 is changed from the low level to the high level (FIG. 11(D)), and in response to this, the triac TR2 is transitioned from the off-state to the on-state. With this, the triac TR2 starts the supply of the power supply signal VAC to the heater H2, and thus the effective value of the total heater electric current IHtotal rises (FIG. 11(B)). With this, the voltage drop amount of the power supply signal VAC is increased, and thus the effective value of the power supply signal VAC drops (FIG. 11(A)). As described above, in the operation OP11, the heater controller 80 controls the heaters H1 and H2, to transition through a first transient state where the heater H1 is not energized and the heater H2 is energized and next a second transient state where the heater H1 is energized and the heater H2 is not energized, and then to start energizing the heater H2. That is, the total heater electric power PW is changed from 0 W to 500 W, and to 1000 W, and then to 1500 W. Accordingly, in the operation OP11, the total heater electric power PW is changed from 0 W to 1500 W in a stepwise manner. Here, time t11 may be a specific example of a "first timing" in this disclosure. A period from time t11 to time t13 may correspond to a specific example of a "first length of time" in this disclosure. Time t13 may correspond to a specific example of a "second timing" and a "third timing" in this disclosure. A period from time t13 to time t14 may correspond to a specific example of a "second length of time" in this disclosure. Time t14 may be a specific example of a "fourth timing" in this disclosure.

Next, the heater controller 80 executes control to change the total heater electric power PW from 1500 W to 0 W. Specifically, the heater controller 80 executes an operation OP12 to change from the state where the triac TR1 and the triac TR2 are both on to the state where the triac TR1 nor the triac TR2 are both off. Here the operation OP12 may be a specific example of a "fourth operation" in this disclosure.

Since time t14, the heater H1 and the heater H2 have been energized. That is, first, the total heater electric power PW is 1500 W. At time t15 after time t14, the heater control signal S2 is changed from the high level to the low level (FIG. 11(D)). In response to this, at time t16 when the power supply signal VAC becomes 0V for the first time after the time t15, the triac TR2 is transitioned from the on-state to the off-state. With this, the triac TR2 stops the supply of the power supply signal VAC to the heater H2, and thus the effective value of the total heater electric current IHtotal drops (FIG. 11(B)). With this, the voltage drop amount of the power supply signal VAC is decreased, and thus the effective value of the power supply signal VAC rises (FIG. 11(A)).

At time t17 after time t16, the heater control signal S1 is changed from the high level to the low level (FIG. 11(C)). In response to this, at time t18 when the power supply signal VAC becomes 0V for the first time after the time t17, the triac TR1 is transitioned from the on-state to the off-state. With this, the triac TR1 stops the supply of the power supply signal VAC to the heater H1. Also, at time t18, the heater control signal S2 is changed, in synchronization with the zero-crossing signal SZ, from the low level to the high level (FIG. 11(D)), and in response to this, the triac TR2 is transitioned from the off-state to the on-state. With this, the triac TR2 starts the supply of the power supply signal VAC to the heater H2. The stopping of the supply of the power supply signal VAC to the heater H1 and the starting of the supply of the power supply signal VAC to the heater H2 cause the effective value of the total heater electric current IHtotal to drop (FIG. 11(B)). With this, the voltage drop amount of the power supply signal VAC is decreased, and thus the effective value of the power supply signal VAC rises (FIG. 11(A)).

At time t19 after time t18, the heater control signal S2 is changed from the high level to the low level (FIG. 11(D)). In response to this, at time t20 when the power supply signal VAC becomes 0V for the first time after the time t19, the triac TR2 is transitioned from the on-state to the off-state. With this, the triac TR2 stops the supply of the power supply signal VAC to the heater H2, and thus the effective value of the total heater electric current IHtotal drops (FIG. 11(B)). With this, the voltage drop of the power supply signal VAC is resolved, and thus the effective value of the power supply signal VAC rises to 100V (FIG. 11(A)). In this way, in the operation OP12, the heater controller 80 controls the heaters H1 and H2 to transition to a first transient state where the heater H1 is energized and the heater H2 is not energized and next a second transient state where the heater H1 is not energized and the heater H2 is energized, and then to stop energizing the heater H2. That is, the total heater electric power PW is changed from 1500 W to 1000 W, and to 500 W, and then to 0 W. Accordingly, in the operation OP12, the total heater electric power PW is changed from 1500 W to 0 W in a stepwise manner.

Here a period from time t11 to time t13, a period from time t13 to time t14, a period from time t16 to time t18, and a period from time t18 to time t20 may be set, for example, to a time length equal to or greater than the predetermined time length T0 (100 milliseconds, for example).

Next, an operation of the power supply part 70 around a time period from time t12 to time t13 in FIG. 11 is described in detail below.

Figure 12:
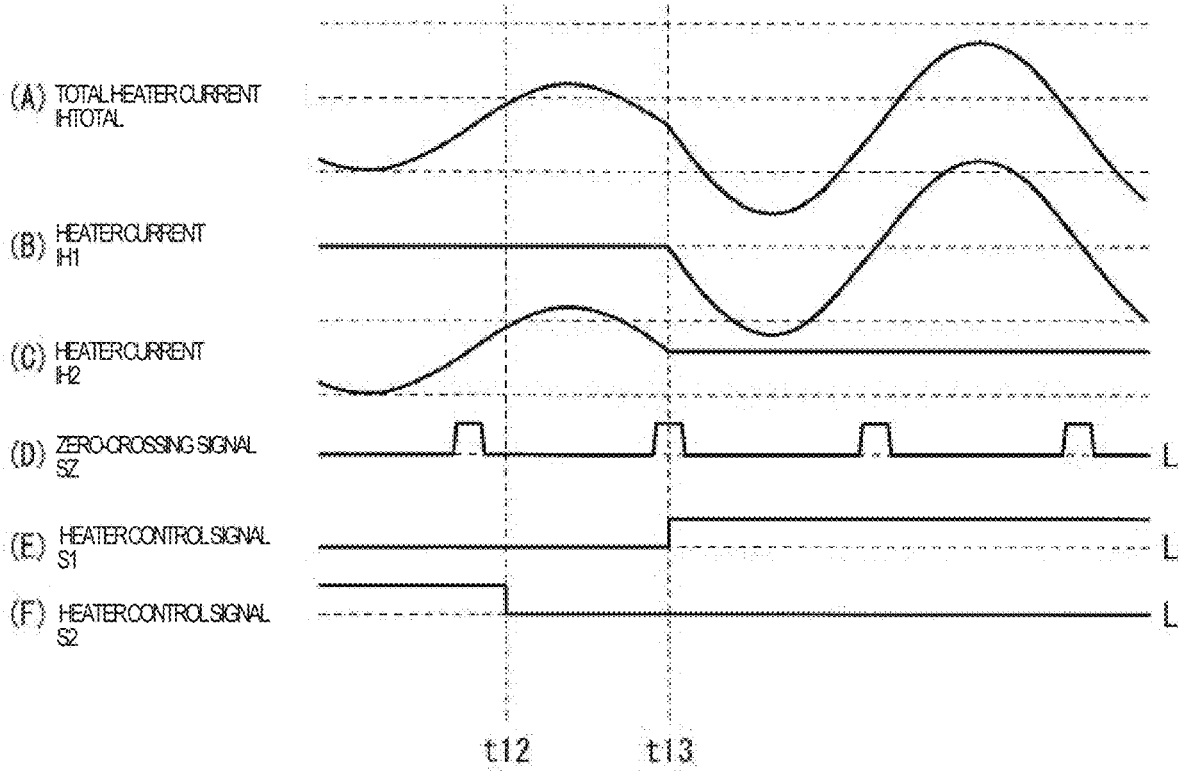
FIG. 12 is another timing diagram illustrating an operation example of the power supply part, such as being illustrated in FIG. 4.

FIG. 12 illustrates an operation example of the power supply 70 around the time period from time t12 to time t13. In FIG. 12, a waveform (A) is a waveform of the total heater electric current IHtotal, a waveform (B) is a waveform of the heater electric current IH1 flowing through the heater H1, a waveform (C) is a waveform of the heater electric current IH2 flowing through the heater H2, a waveform (D) is a waveform of the zero-crossing signal SZ, a waveform (E) is a waveform of the heater control signal S1, and a waveform (F) is a waveform of the heater control signal S2.

As described above, at time t12, the heater control signal S2 is changed from the high level to the low level (FIG. 12(F)), and then at time t13 when the power supply signal VAC becomes 0V for the first time after time t12, the triac TR2 is transitioned from the on-state to the off-state. In the time period from time t12 to time t13, the triac TR1 is in the off-state and thus the heater electric current IH1 is not flowed, and the triac TR2 is in the on-state and thus the heater electric current IH2 is flowed. At time t13, the heater control signal S1 is changed, in synchronization with the zero-crossing signal SZ, from the low level to the high level (FIG. 12(E)), and thus the triac TR1 is transitioned from the off-state to the on-state. With this, after time t13, the heater electric current IH1 is flowed and the heater electric current IH2 is not flowed. That is, the heater electric current IH1 and the heater electric current IH2 are not flowed at the same time. With this, the power supply part 70 suppresses a transient increase in the total heater electric current IHtotal. Note that, in this example, the timing when the heater control signal S1 is changed from the low level to the high level is set to a central timing (midpoint) of the time period when the zero-crossing signal SZ is in the high level. However, it is not limited to this. For example, the timing when the heater control signal S1 is changed from the low level to the high level may be set to the terminal timing (end timing) of the time period when the zero-crossing signal SZ is in the high level.

Comparative Example

Next, in comparison with the operation according to an embodiment, an operation of a comparative example is described below. An image formation apparatus 1R according to the comparative example is configured, upon a power change control of the total heater electric power PW, to directly change the total heater electric power PW always without changing the total heater electric power PW in a stepwise manner. The image formation apparatus 1R includes a heater controller 80R. The other configurations of the image formation apparatus 1R are the same as those of an embodiment (FIG. 3) described above. An operation of the heater controller 80R upon changing the total heater electric power PW is described using a specific example below.

Figure 13:
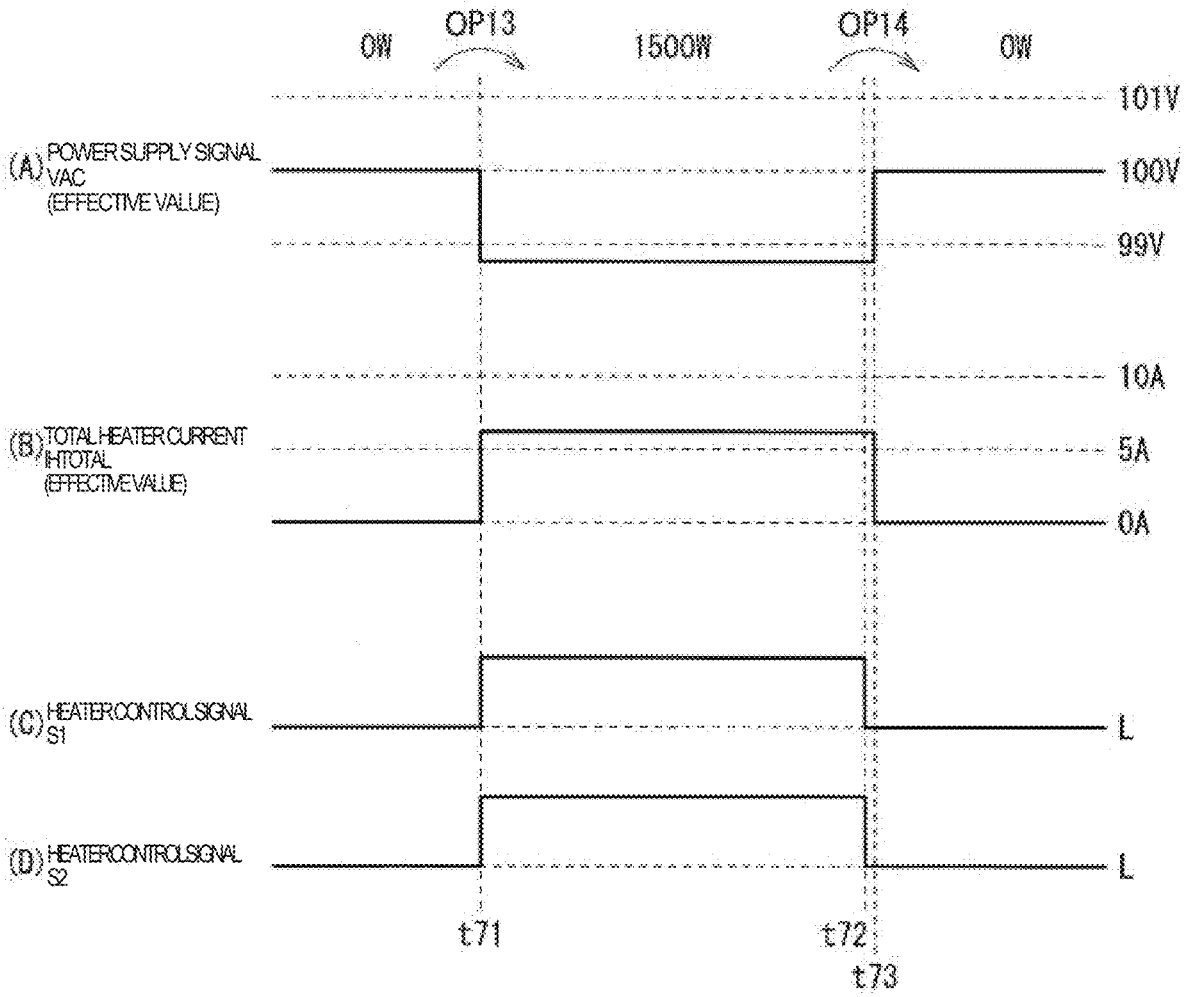
FIG. 13 is a timing diagram illustrating an operation example of a power supply part according to a comparative example.

FIG. 13 illustrates an example of a power change control of the image formation apparatus 1R according to the comparative example. In this comparative example illustrated in FIG. 13, the heater controller 80R changes the total heater electric power PW from 0 W to 1500 W directly and from 1500 W to 0 W directly. FIG. 13 related to the comparative example is to be compared to FIG. 11 related to an embodiment.

First, the heater controller 80R controls to change the total heater electric power PW from 0 W to 1500 W. Specifically, the heater controller 80R executes an operation OP13 to change from the state where the triac TR1 and the triac TR2 are both off to the state where the triac TR1 and the triac TR2 are both on.

In FIG. 13, the operation starts from the state where the heater H1 and the heater H2 are both de-energized. That is, first, the total heater electric power PW is 0 W. At time t71, the heater control signal S1 is changed from the low level to the high level (FIG. 13(C)), and in response to this, the triac TR1 is transitioned from the off-state to the on-state. Also, at time t71, the heater control signal S2 is changed from the low level to the high level (FIG. 13(D)), and in response to this, the triac TR2 is transitioned from the off-state to the on-state. With this, the triac TR1 starts the supply of the power supply signal VAC to the heater H1 and the triac TR2 also starts the supply of the power supply signal VAC to the heater H2, and thus the effective value of the total heater electric current IHtotal rises (FIG. 13(B)). With this, a voltage drop of the power supply signal VAC occurs, and thus the effective value of the power supply signal VAC drops from 100V (FIG. 13(A)). In this way, the heater controller 80R starts energizing both the heaters H1 and H2. That is, the total heater electric power PW becomes 1500 W. In this way, in the operation OP13, the total heater electric power PW is changed from 0 W to 1500 W directly.

Next, the heater controller 80R executes control to change the total heater electric power PW from 1500 W to 0 W. Specifically, the heater controller 80R executes an operation OP14 to change from the state where the triac TR1 and the triac TR2 are both on to the state where the triac TR1 and the triac TR2 are both off.

Since time t71, the heater H1 and the heater H2 have been energized. That is, the total heater electric power PW is 1500 W. At time t72 after time t71, the heater control signal S1 is changed from the high level to the low level (FIG. 13(C)). In response to this, at time t73 when the power supply signal VAC becomes 0V for the first time after the time t72, the triac TR1 is transitioned from the on-state to the off-state. Also, at time t72, the heater control signal S2 is changed from the high level to the low level (FIG. 13(D)). In response to this, at time t73 when the power supply signal VAC becomes 0V for the first time after the time t72, the triac TR2 is also transitioned from the on-state to the off-state. With this, the triac TR1 stops the supply of the power supply signal VAC to the heater H1 and the triac TR2 also stops the supply of the power supply signal VAC to the heater H2. With this, the effective value of the total heater electric current H1 drops (FIG. 13(B)). Accordingly, the voltage drop of the power supply signal VAC is resolved, and thus the effective value of the power supply signal VAC rises to 100V (FIG. 13(A)). In this way, the heater controller 80R stops energizing both the heater H1 and the heater H2. That is, the total heater electric power PW becomes 0 W. Accordingly, in the operation OP15, the total heater electric power PW is changed from 1500 W to 0 W directly.

Figure 14:
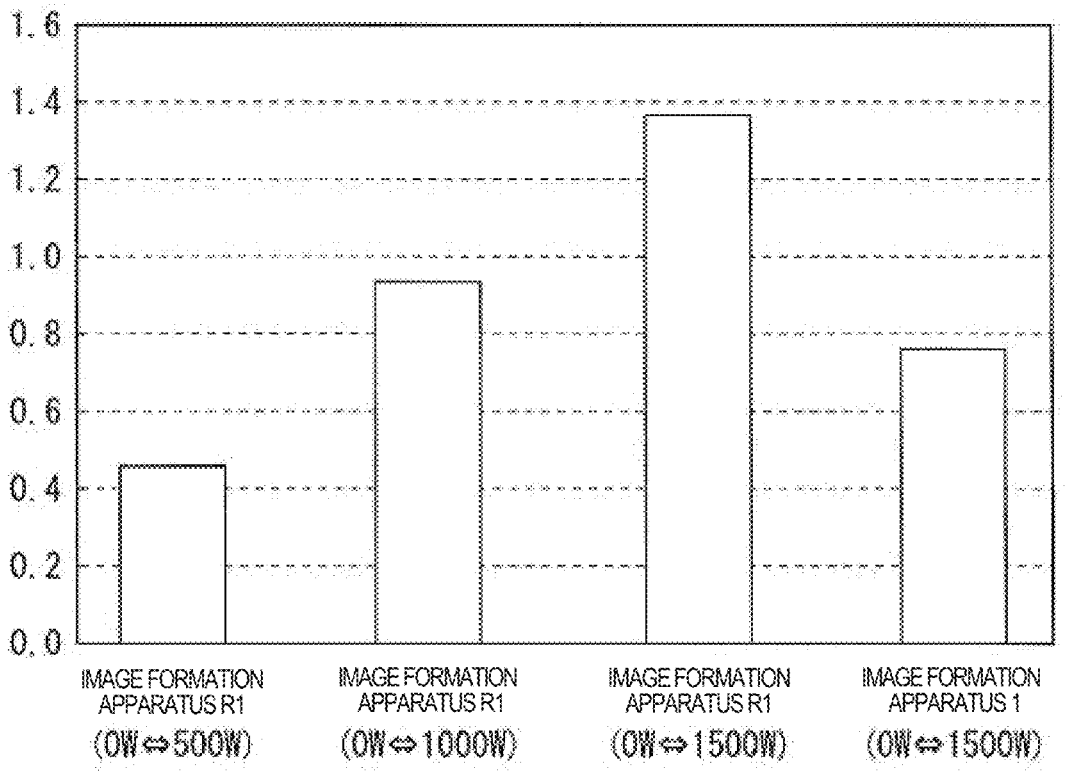
FIG. 14 is a characteristic diagram illustrating an example of experimental results.

FIG. 14 illustrates an example of experimental results of flicker values of the image formation apparatus R1 according to the comparative example and the image formation apparatus 1 according to an embodiment. In the experiments, the flicker values are measured while repeating an operation of turning on the heater(s) for one second and an operation of turning off the heater(s) for one second.

In the image formation apparatus 1R according to the comparative example, the flicker value is about 0.45 when the heater controller 80R changes the total heater electric power PW alternately between 0 W and 500 W, the flicker value is about 0.95 when the heater controller 80R changes the total heater electric power PW alternatingly between 0 W and 1000 W, and the flicker value is about 1.4 when the heater controller 80R changes the total heater electric power PW alternately between 0 W and 1500 W. To the contrary, in the image formation apparatus 1 according to an embodiment, the flicker value is about 0.8 when the heater controller 80 changes the total heater electric power PW alternatingly between 0 W and 1500 W.

It may be generally desired that the flicker value be 1 or less. When the flicker value is 1 or less, a people may be less likely to recognize the change in brightness of the lighting device connected to the AC power source 71 and thus may be less likely to recognize flickers, whereas when the flicker value is more than 1, the people may possibly recognize flickers.

In the image formation apparatus 1R according to the comparative example, when the heater controller 80R changes the total heater electric power PW between 0 W and 1500 W alternatingly, the flicker value exceeds the value of 1 as illustrated in FIG. 14. That is, in the image formation apparatus 1R, for example, at time t71 (see FIG. 13) when the heater electric current IH1 starts to flow through the heater H1 and the heater electric current IH2 starts to flow through the heater H2, a large voltage change occurs in the power supply signal VAC. Similarly, in the image formation apparatus 1R, at time t73 (see FIG. 13) when the heater electric current IH1 and the heater electric current IH2 stops in the heater H1 and the heater H2, a large voltage change occurs in the power supply signal VAC. Accordingly, by repeating such operations, large voltage changes repeatedly occur in the power supply signal VAC, and thus the flicker value becomes high. Therefore, in this case, a people may feel flickers.

To the contrary, in the image formation apparatus 1 according to an embodiment, when the heater controller 80 controls to change the total heater electric power PW between 0 W and 1500 W alternatingly, the flicker value is less than the value of 1. Specifically, as illustrated in FIG. 11, at time t11, only the heater electric current IH2 flows through the heater H2, and this cause a first voltage change in the power supply signal VAC. Then at time t13, only the heater electric current IH1 flows through the heater H1, and this cause a second voltage change in the power supply signal VAC. And then at time t14, the heater electric current IH1 and the heater electric current IH2 flow through the heaters H1 and H2 respectively, and this causes a third voltage change in the power supply signal VAC. Due to such a stepwise voltage change in the power supply signal VAC, the brightness of the lighting device connected to the AC power source 71 is changed in a stepwise manner. Especially, since the time length between the first voltage change and the time length of the second voltage change are set to equal to or more than the predetermined time length T0 (for example, 100 milliseconds), abrupt voltage changes are less likely to occur in the power supply signal VAC, in compared to the time length is shorter than that. Accordingly, the people may be less likely to recognize abrupt changes of the brightness of the lighting device connected to the AC power source 71. As a result, it is possible to reduce the possibility of flickering.

As described above, because the image formation apparatus 1 changes the total heater electric power PW in the stepwise manners, the image formation apparatus 1 can suppress abrupt voltage changes in the power supply signal VAC and thus can suppress flickering. Also, because the image formation apparatus 1 changes the total heater electric power PW in the stepwise manners, the image formation apparatus 1 can suppress abrupt changes in the total heater electric current IHtotal, and thus can suppress harmonic noise and radiation.

Especially in the image formation apparatus 1, for example, in the operation OP11 (FIG. 11) to change the total heater electric power PW from 0 W to 1500 W, the heater controller 80 in the image formation apparatus 1: turns on the triac TR2 from the off-state at time t11; turns off the triac TR2 from the on-state and turns on the triac TR1 from the off-state at timing t13 at which a time length not less than the time length T0 (for example, 100 milliseconds) has elapsed from timing t11; and turns on the triac TR2 from the off-state at timing t14 at which a time length not less than the time length T0 (for example, 100 milliseconds) has elapsed from timing t13. Accordingly, as illustrated in FIG. 11(A), the voltage changes occur three times in the power supply signal VAC in the operation OP11 or the operation OP12, so as to reduce a voltage change amount per change. This can prevent an abrupt voltage change and thus can suppress flickers. Similarly, as illustrated in FIG. 11(B), the electrical current changes occur three times in the total heater electric current IHtotal in the operation OP11 or the operation OP12, so as to reduce an electric current change amount per change. This can prevent an abrupt current change and thus can suppress harmonic noises and radiation noises.

Further, in the image formation apparatus 1, as illustrated in FIGS. 11 and 12, the heater controller 80 turns off the triac TR2 from the on-state at timing t13 at which the time length not less than the time length T0 has elapsed from timing t11, and, at this timing, turns on the triac TR1 from the off-state. That is, in the operation to start to energize one of the heaters H1 and H2 and stop to energize the other of the heaters H1 and H2, the heater controller 80 prevents the heater electric current IH1 and the heater electric current IH2 from concurrently flowing even temporarily. With this, the image formation apparatus 1 can reduces flickers and suppress harmonic noises and radiation noises.

[Effects]

According to an embodiment, a total heater electric power is changed in a stepwise manner. This can prevent an abrupt voltage change in a power supply signal so as to reduce flickers and also can prevent an abrupt electric current change in a total heater electric current so as to suppress harmonic noises and radiation noises.

According to an embodiment, upon an operation to change a total heater electric power, for example, from 0 W to 1500 W, the embodiment turns on a triac TR2 from the off-state at time t11, turns off the triac TR2 from the on-state and turns on a triac TR1 from the off-state at timing t13 at which a time length not less than the time length T0 (for example, 100 milliseconds) has elapsed from timing t11, and turns on the triac TR2 from the off-state at timing t14 at which a time length not less than the time length T0 (for example, 100 milliseconds) has elapsed from timing t13. Accordingly, this can reduce flickers and suppress harmonic noises and radiation noises.

According to an embodiment, upon an operation to change a total heater electric power, for example, from 0 W to 1500 W, the embodiment turns off a triac TR2 from the on-state at timing t13 at which a time length not less than the time length T0 (for example, 100 milliseconds) has elapsed from timing t11 and, at this timing, turns on a triac TR1 from the off-state. Accordingly, this can reduce flickers and suppress harmonic noises and radiation noises.

[Modification 1]

In one or more embodiments described above, at time t13 in the operation OP 11 to change the total heater electric power PW from 0 W to 1500 W (FIG. 11), the triac TR2 is transitioned from the on-state to the off-state and the triac TR1 is transitioned from the off-state to the on-state. However, the invention is not limited to this. For example, in a modification, the triac TR1 may be transitioned from the off-state to the on-state after the triac TR2 is transitioned from the on-state to the off-state. An image formation apparatus 1A according to such a modification is described in detail below. The image formation apparatus 1A includes a heater controller 80A, as in the case of an embodiment (FIGS. 3 and 4) described above.

Figure 15:
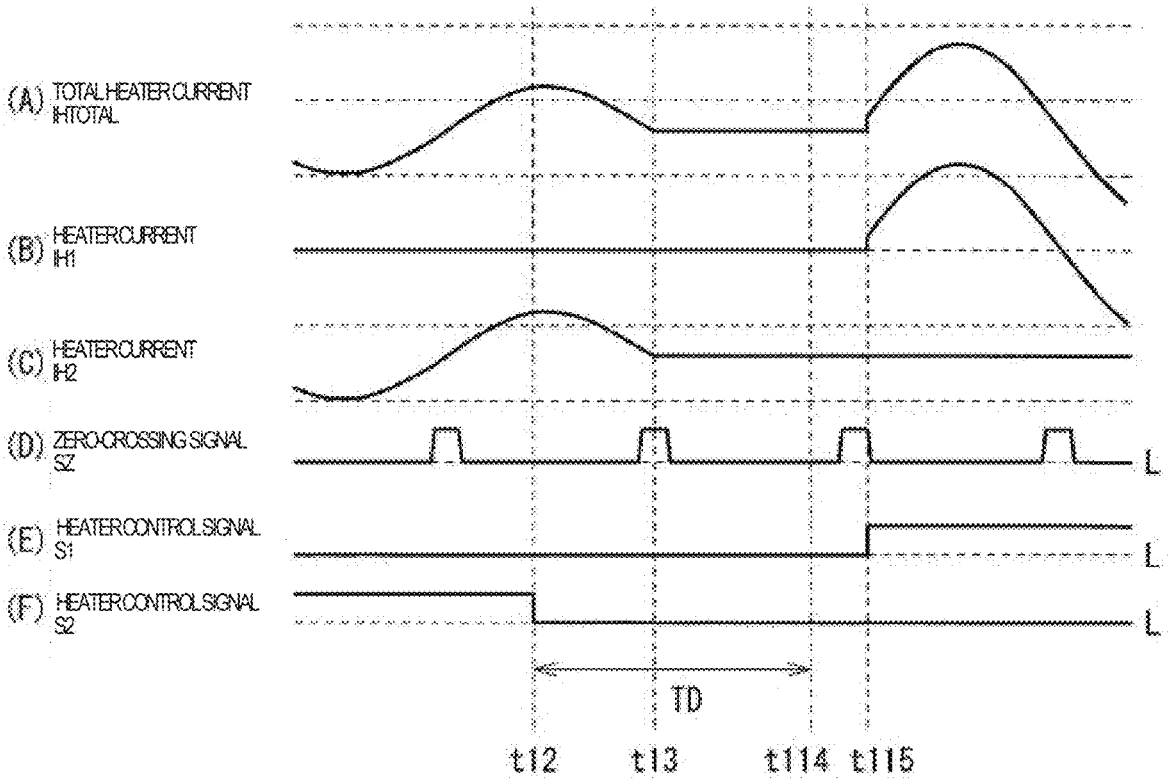
FIG. 15 is a timing diagram illustrating an operation example of a power supply part according to a modification.

FIG. 15 illustrates an operation example of the power supply part 70 of the image formation apparatus 1A according to the modification around a time period from time t12 to time t13. FIG. 15 illustrating the modification is to be compared to FIG. 12 illustrating an embodiment.

At time t12 in FIG. 15, the heater control signal S2 is changed from the high level to the low level (FIG. 15(F)), and in response to this, at time t13 when the power supply signal VAC becomes 0V for the first time after time t12, the triac TR2 is transitioned from the on-state to the off-state (FIG. 15(C)). At time t115 in FIG. 15, the heater control signal S1 is changed, in synchronization with the zero-crossing signal SZ, from the low level to the high level (FIG. 15(E)), and in response to this, the triac TR1 is transitioned from the off-state to the on-state (FIG. 15(B)). In a time period from time t13 to time t115, the triacs TR1 and R2 are both in the off-state (FIG. 15(B) and FIG. 15(C)). Note that, if the time period from time t13 to time t115 is set to not more than 30 milliseconds, a people around or under the lighting device connected to the AC power source 71 may be less likely to recognize flickers, because the human is less likely recognize flickers more than about 30 Hz, caused by the voltage change in not more than about 30 milliseconds. Thus, the time period from time t13 to time t115 in the modification may be set to not more than 30 milliseconds, so as to reduce flickers.

The heater controller 80A changes the heater control signal S1 from the low level to the high level at a timing (time t115 in this modification) when a pulse of the zero-crossing signal SZ occurs for the first time after a timing (time t114 in this modification) when a predetermined time length TD (for example, 15 milliseconds) has elapsed from a timing (time t12 in this modification) when the heater control signal S2 is transitioned from the high level to the low level. With this operation, a time period during which both the triacs TR1 and TR2 are in the off-state is not more than 30 milliseconds. Accordingly, this can reduce flickers.

Note that in this modification, the heater controller 80A changes the heater control signal S1 from the low level to the high level, at the timing when the pulse occurs in the zero-crossing signal SZ for the first time after the timing when the predetermined time length TD has elapsed from the timing when the heater controller 80A changes the heater control signal S2 from the high level to the low level. That is, at the timing synchronized with the zero-crossing signal SZ, the heater control signal S1 is changed from the low level to the high level. Instead of this operation, the heater control signal S1 may not be synchronized with the zero-crossing signal SZ. In such a case, the heater controller 80A may change the heater control signal S1 from the low level to the high level at a timing when a predetermined time length TD1 (for example, 20 milliseconds) has elapsed from a timing when the heater controller 80A changes the heater control signal S2 from the high level to the low level.

Similarly, in one or more embodiments described above, at time t53 in the operation OP7 (FIG. 9) to change the total heater electric power PW from 0 W to 1000 W, the triac TR2 is transitioned from the on-state to the off-state and the triac TR1 is transitioned from the off-state to the on-state. However, the invention is not limited to this. For example, after the triac TR2 is transitioned from the on-state to the off-state, the triac TR1 may be transitioned from the off-state to the on-state.

Similarly, in one or more embodiments described above, at time t62 in the operation OP9 (FIG. 10) to change the total heater electric power PW from 500 W to 1500 W, the triac TR2 is transitioned from the on-state to the off-state and the triac TR1 is transitioned from the off-state to the on-state. However, the invention is not limited to this. For example, after the triac TR2 is transitioned from the on-state to the off-state, the triac TR1 may be transitioned from the off-sate to the on-state.

Similarly, in one or more embodiments described above, at time t18 in the operation OP12 (FIG. 11) to change the total heater electric power PW from 1500 W to 0 W, the triac TR1 is transitioned from the on-state to the off-state and the triac TR2 is transitioned from the off-state to the on-state. However, the invention is not limited to this. For example, after the triac TR1 is transitioned from the on-state to the off-state, the triac TR2 may be transitioned from the off-state to the on-state.

[Modification 2]

In one or more embodiments described above, at time t13 in the operation OP1 1 (FIG. 11), the triac TR2 is transitioned from the on-state to the off-state and the triac TR1 is transitioned from the off-state to the on-state, so as to prevent both the heater electric current IH1 and the heater electric current IH2 from concurrently flowing even temporarily. However, the invention is not limited to this. For example, in a modification, the triac TR1 may be transitioned from the off-state to the on-state, before the triac TR2 is transitioned from the on-state to the off-state. An image formation apparatus 1B according to such a modification is described in detail below.

Figure 16:
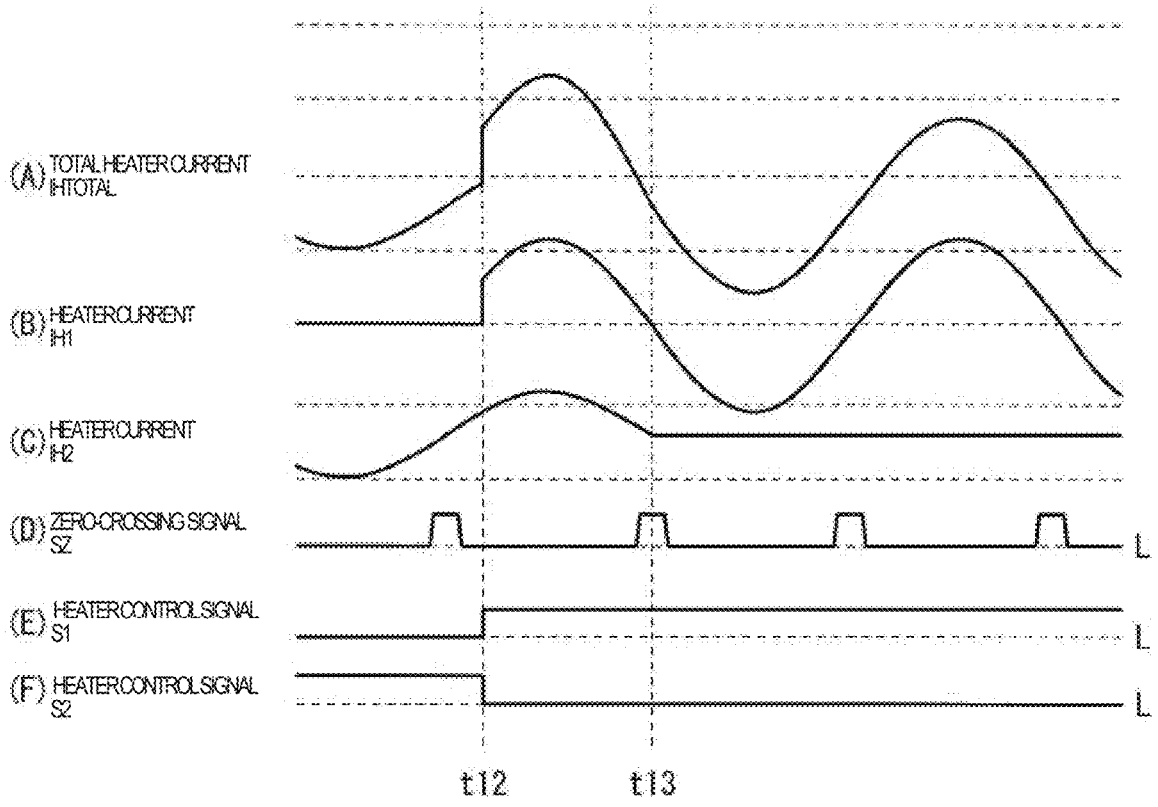
FIG. 16 is a timing diagram illustrating an operation example of a power supply part according to another modification.

FIG. 16 illustrates an operation example of the power supply part 70 of the image formation apparatus 1B according to the modification around a time period from time t12 to time t13.

At time t12 in FIG. 16, the heater control signal S2 is transitioned from the high level to the low level (FIG. 16(F)), and in response to this, at time t13 when the power supply signal VAC becomes 0V for the first time after time t12, the triac TR2 is transitioned from the on-state to the off-state (FIG. 16(C)). At time t12 in FIG. 16, the heater control signal S1 is also transitioned from the low level to the high level (FIG. 16(E)), and in response to this, the triac TR1 is transitioned from the off-state to the on-state (FIG. 16(B)). With this operation, in the time period from time t12 to time t13, the heater electric current IH1 and the heater electric current IH2 are concurrently flowed temporarily. Accordingly, the modification illustrated in FIG. 16 may reduce the improvement effect for flickers, compared to one or more embodiments described above. However, if the characteristics of the modification is acceptable, the modification can be applied.

[Modification 3]

In one or more embodiments described above, the time length T0 is set to 100 milliseconds. However, the invention is not limited to this. For example, the time period T0 may be not less than 30 milliseconds. If the time period T0 is set to less than 30 milliseconds, abrupt changes in the brightness of the lighting device may occur. For example, the time T0 may be set to an appropriate time length, in view of the temperature controllability of the fixation device 40 and the improvement effect for flickers.

[Other Modifications]

Further, two or more of the modifications described above may be combined.

Although technical features have been described above with reference to one or more embodiments and modifications described above, the technical features are not limited to one or more embodiments and modifications described above, and various modifications and combinations are possible.

For example, in one or more embodiments, the same time length T0 is set in all the operations OP7 to OP12. However, instead of this, different predetermined time lengths may be set in the operations OP7 to OP12, respectively.

For example, in one or more embodiments described above, the technical features are applied to the single function printer. However, the invention is not limited to this. For example, one or more of the technical features may be applied to a so-called Multi-Function Peripheral (MFP) having, for example, a copy function, a facsimile function, a scan function, a print function, and the like.

For example, in one or more embodiments described above, the technical features are applied to the heaters H1 and H2 of the fixation device 40. However, the invention is not limited to this. For example, one or more of the technical features may be applied to another heater in an image formation apparatus, such a heater to adjust the temperature or the humidity in the medium container 5 or the like.

The invention includes other embodiments or modifications in addition to one or more embodiments and modifications described above without departing from the spirit of the invention. One or more embodiments and modifications described above are to be considered in all respects as illustrative, and not restrictive. The scope of the invention is indicated by the appended claims rather than by the foregoing description. Hence, all configurations including the meaning and range within equivalent arrangements of the claims are intended to be embraced in the invention.

The invention claimed is:

1. An image formation apparatus comprising:

an image formation unit that forms an image on a recording medium by using a developer;

a fixation device including a first heater and a second heater, wherein the first heater generates heat with a first heater electric power and the second heater generates heat with a second heater electric power smaller than the first heater electric power;

a first switch comprising a first triac configured, based on a first control signal, to supply a power supply signal to the first heater;

a second switch comprising a second triac configured, based on a second control signal, to supply the power supply signal to the second heater; and a heater controller that generates the first control signal and the second control signal to the first switch and the second switch to supply the power supply signal to the first heater and the second heater, wherein the first control signal comprises a first on-voltage that turns on the first triac and a first off-voltage that turns off the first triac, and the second control signal comprises a second on-voltage that turns on the second triac and a second off-voltage that turns off the second triac, wherein upon a first operation to transition from a state where the first and second switches are off to a state where the first and second switches are on, the heater controller:

at a first timing, turns on the second switch from an off-state thereof;

at a second timing at which a first length of time equal to or longer than a predetermined time length has elapsed from the first timing, turns off the second switch from an on-state thereof;

at a third timing after the second timing, turns on the first switch from an off-state thereof; and at a fourth timing at which a second length of time equal to or longer than the predetermined time length has elapsed from the third timing, turns on the second switch from the off-state thereof.

2. The image formation apparatus according to claim 1, wherein upon a second operation to transition from the state where the first and second switches are off to a state where the first switch is on and the second switch is off, the heater controller:

at a fifth timing, turns on the second switch from the off-state thereof;

at a sixth timing at which a third length of time equal to or longer than the predetermined time length has elapsed from the fifth timing, turns off the second switch from the on-state thereof; and at a seventh timing after the sixth timing, turns on the first switch from the off-state thereof.

3. The image formation apparatus according to claim 1, wherein upon a third operation to transition from a state where the first switch is off and the second switches is on to the state where the first and second switches are on, the heater controller:

at an eighth timing, turns off the second switch from the on-state thereof;

at a ninth timing after the eighth timing, turns on the first switch from the off-state thereof; and at a tenth timing at which a fourth length of time equal to or longer than the predetermined time length has elapsed from the ninth timing, turns on the second switch from the off-state thereof.

4. The image formation apparatus according to claim 1, wherein upon a fourth operation to transition from the state where the first and second switches are on to the state where the first and second switches are off, the heater controller:

at an eleventh timing, turns off the second switch from the on-state thereof;

at a twelfth timing at which a fifth length of time equal to or longer than the predetermined time length has elapsed from the eleventh timing, turns off the first switch from an on-state thereof;

at a thirteenth timing after the twelfth timing, turns on the second switch from the off-state thereof; and at a fourteenth timing at which a sixth length of time equal to or longer than the predetermined time length has elapsed from the thirteenth timing, turns off the second switch from the on-state thereof.

5. The image formation apparatus according to claim 1, wherein the predetermined time length is equal to or longer than 30 milliseconds.

6. The image formation apparatus according to claim 1, wherein the third timing is a timing when not more than 30 milliseconds has been elapsed from the second timing.

7. The image formation apparatus according to claim 2, wherein the sixth timing is a timing when not more than 30 milliseconds has been elapsed from the fifth timing.

8. The image formation apparatus according to claim 3, wherein the ninth timing is a timing when not more than 30 milliseconds has been elapsed from the eighth timing.

9. The image formation apparatus according to claim 1, wherein the first triac is transitioned from the on-state to the off-state when a polarity of the power supply signal is inverted for the first time after the first control signal is transitioned from the first on-voltage to the first off-voltage, and the second triac is transitioned from the on-state to the off-state when a polarity of the power supply signal is inverted for the first time after the second control signal is transitioned from the second on-voltage to the second off-voltage.

10. The image formation apparatus according to claim 9, wherein upon the first operation, the heater controller:

at a fifteenth timing before the second timing, changes the second control signal from the second on-voltage to the second off-voltage; and at the third timing after a timing at which a predetermined stand-by time has elapsed from the fifteenth timing, changes the first control signal from the first off-voltage to the first on-voltage.

11. An image formation apparatus comprising:

an image formation unit that forms an image on a recording medium by using a developer;

a fixation device including a first heater and a second heater, wherein the first heater generates heat with a first heater electric power and the second heater generates heat with a second heater electric power smaller than the first heater electric power;

a first switch comprising a first triac configured, based on a first control signal, to supply a power supply signal to the first heater;

a second switch comprising a second triac configured, based on a second control signal, to supply the power supply signal to the second heater; and a heater controller that generates the first control signal and the second control signal to the first switch and the second switch to supply the power supply signal to the first heater and the second heater, wherein the first control signal comprises a first on-voltage that turns on the first triac and a first off-voltage that turns off the first triac, and the second control signal comprises a second on-voltage that turns on the second triac and a second off-voltage that turns off the second triac, wherein upon an operation to transition from a state where the first and second switches are on to a state where the first and second switches are off, the heater controller:

at a first timing, turns off the second switch from an on-state thereof;

at a second timing at which a first length of time equal to or longer than a predetermined time length has elapsed from the first timing, turns off the first switch from an on-state thereof;

at a third timing after the second timing, turns on the second switch from an off-state thereof; and at a fourth timing at which a second length of time equal to or longer than the predetermined time length has elapsed from the third timing, turns off the second switch from the on-state thereof.

12. A heater control method comprising:

a first operation to transition from a state where first and second switches are off to a state where the first and second switches are on, wherein the first switch comprises a first triac which is configured, based on a first control signal, to supply a power supply signal to a first heater that generates heat with a first heater electric power and the second switch comprising a second triac which is configured, based on a second control signal, to supply the power supply signal to a second heater that generates heat with a second heater electric power smaller than the first heater electric power, and wherein the first control signal comprises a first on-voltage that turns on the first triac and a first off-voltage that turns off the first triac, and the second control signal comprises a second on-voltage that turns on the second triac and a second off-voltage that turns off the second triac, wherein the first operation comprises:

at a first timing, turning on the second switch from an off-state thereof;

at a second timing at which a first length of time equal to or longer than a predetermined time length has elapsed from the first timing, turning off the second switch from an on-state thereof;

at a third timing after the second timing, turning on the first switch from an off-state thereof; and at a fourth timing at which a second length of time equal to or longer than the predetermined time length has elapsed from the third timing, turning on the second switch from the off-state thereof.

* * * * *